US007384181B1

(12) United States Patent
Collette

(10) Patent No.: US 7,384,181 B1
(45) Date of Patent: Jun. 10, 2008

(54) MILLED ASPHALT PAVEMENT RECYCLING

(76) Inventor: Jerry R. Collette, 1251 E. 279th St., Unit J, Euclid, OH (US) 44132

( * ) Notice: Subject to any disclaimer, the term of this patent is extended or adjusted under 35 U.S.C. 154(b) by 396 days.

(21) Appl. No.: 11/075,849

(22) Filed: Mar. 10, 2005

Related U.S. Application Data

(60) Provisional application No. 60/559,022, filed on Apr. 5, 2004.

(51) Int. Cl.
*B28C 5/46* (2006.01)
*B28C 9/00* (2006.01)

(52) U.S. Cl. ..... 366/7; 366/15; 366/25; 366/50; 366/147; 366/149; 432/139; 432/152

(58) Field of Classification Search ..... 366/22–25, 366/50, 7, 14–15, 147, 149, 64–66; 432/120–213; 404/92, 115; 165/109.1
See application file for complete search history.

(56) References Cited

U.S. PATENT DOCUMENTS

| | | | | |
|---|---|---|---|---|
| 2,257,637 | A | | 9/1941 | Moore |
| 4,226,552 | A | | 10/1980 | Moench |
| 4,261,669 | A | | 4/1981 | Edo |
| 4,338,869 | A | * | 7/1982 | Hoskinson |
| 4,418,682 | A | | 12/1983 | Heller |
| 4,522,587 | A | | 6/1985 | Miller |
| 4,540,287 | A | * | 9/1985 | Servas et al. |
| 4,620,645 | A | | 11/1986 | Hale |
| 4,793,730 | A | | 12/1988 | Butch |
| 5,096,331 | A | | 3/1992 | Raymond |
| 5,120,217 | A | | 6/1992 | O'Brien et al. |
| 5,219,450 | A | | 6/1993 | Thurk |
| 5,259,693 | A | | 11/1993 | Raymond |
| 5,277,490 | A | * | 1/1994 | Boon |
| 5,470,146 | A | | 11/1995 | Hawkins |
| 5,547,277 | A | * | 8/1996 | Caspelherr et al. |
| 5,692,831 | A | * | 12/1997 | Campbell |
| 5,766,333 | A | | 6/1998 | Lukens |
| 6,267,497 | B1 | * | 7/2001 | Rhee |
| 7,160,021 | B2 | * | 1/2007 | Yamazaki et al. |

FOREIGN PATENT DOCUMENTS

| | | | |
|---|---|---|---|
| GB | 2115711 A | * | 9/1983 |
| WO | 89/03914 | * | 5/1989 |

* cited by examiner

*Primary Examiner*—Charles E. Cooley
(74) *Attorney, Agent, or Firm*—James Creighton Wray; Clifford D. Hyra

(57) ABSTRACT

A milled materials processor consists of a self contained, stationary or fully mobile thermal process plant for the thermal processing of 100% recycled asphalt pavement into new hot mix paving material. Mobile units are designed for transportation by vehicle to a job site and rapid arrangement. For example, the milled materials processing unit at the standard legal load or non-permit load size and configuration processes approximately 25 tons per hour of pre-sized recycled asphalt pavement materials, approximately 50,000 lbs gross, having up to 3% moisture content. Larger unit sizes are available in transportable configurations of 10' wide×54' long, and 12' wide×62' long. Alternatively, units are designed and erected as stationary modular systems for higher tonnage capacities from approximately 200 tons per hour to approximately 400 tons per hour and higher.

58 Claims, 23 Drawing Sheets

Prior Art

MILLED ASPHALT PAVEMENT RECYCLING

This application claims the benefit of U.S. Provisional Application No. 60/559,022, filed Apr. 5, 2004. U.S. Provisional Application No. 60/559,022, filed Apr. 5, 2004 is hereby incorporated by reference in its entirety.

FIELD OF THE INVENTION

The present invention relates to the thermal processing and restoration of used asphalt paving materials after they have been removed from road surfaces by milling, grinding or ripping.

BACKGROUND OF THE INVENTION

After bituminous paving materials have been removed from a roadbed, they are hereafter referred to as recycled asphalt pavement or RAP.

It is generally known that the majority of existing roadways, both concrete and bituminous asphalt, undergo constant repair and surface overlay with new hot mix asphalt to achieve and maintain safe and comfortable high speed riding surfaces.

In recent years, new equipment has been introduced to the road paving industry in the form of pavement milling or grinding machines. The science of preparing an old roadbed base for new resurfacing is now commonly referred to as milling. Both state and Federal Department of Transportation (DOT) agencies throughout the country have readily accepted the science of milling.

The milling of old road surfaces provides a number of advantages in preparing the old roadbed for resurfacing. Milling not only ensures a new, smooth and level base for the new hot mix overlay, but at the same time lowers the road bed height to maintain bridge deck clearances and curb and gutter depths. Grinding or milling is also beneficial in removing potholes, old cracks, joint seams, and ruts along with other surface damage that would quickly reappear in a new surface overlay if not repaired. With many of the state and Federal DOT agencies now requiring the milling of road surfaces before permitting new overlay, there is an increasing inventory of asphalt millings being generated. The piles of discarded asphalt millings are becoming problems for land use, aesthetics and the environment. Attempts at reuse have proven difficult.

Needs exist for new recycling methods and apparatus for asphalt paving millings.

SUMMARY OF THE INVENTION

Using the methods and apparatus of the present invention, asphalt pavement millings are recycled with economic benefit. Recycled asphalt pavement ("RAP") millings are a valuable source of aggregate, screenings, sand, fines and asphaltic bituminous binders (asphalt) that are reused to manufacture new hot mix asphalt pavement.

The liquid petroleum savings alone from recycling old pavement is significant. For every ton of RAP millings that are recycled into new pavement, 12 gallons of liquid asphalt are saved and reused. Using the method and apparatus of the present invention, a typical system is capable of recycling at least a minimum of approximately 100 tons of millings per hour. Therefore, each hour of production recovers approximately 1,250 gallons of liquid asphalt. A typical 12 hour paving day, produces approximately 1,200 tons of recycled hot mix paving and recovers approximately 15,000 gallons of asphalt. At a net average cost of approximately $185.00 per ton for liquid asphalt, this results in savings of roughly $11,100 per day.

Liquid asphalt is by far the most significant cost ingredient in a mix. The new techniques of milling the old pavement produce a uniformly crushed and pre-sized material that is usually about 1½" minus in size.

When the crushed and sized millings are fed into the new process system, the millings are slowly and gradually heated by applying a controlled amount of indirect conductive heat, at a precise temperature level, with extended exposure time (for example, approximately 6 to 12 minutes). The old asphalt binder material gradually melts and re-liquefies. During this process, the materials recover a majority of original properties, such as elasticity, compactive ability and a fluid state. It may be necessary to inject small amounts of virgin liquid asphalt to supplement the light end petroleum constituents that were thermally vaporized and lost in the original manufacturing process. There are a number of chemical and polymer rejuvenating agents that may be used to enhance the weathered liquid asphalt binders and bring them back to life.

This invention recycles 100% of the milling material into new hot mix paving materials.

Many of the existing, conventional hot mix asphalt plants supplying new asphalt to our roads have added small percentages of recycled milling to their virgin plant mix materials. As a general rule, however, those plants can only use about 20% to 30% ratios of the recycled millings in the new hot mix asphalt without creating excess air pollution emissions such as hydrocarbon smoke, dust and petroleum fumes.

The amount of recycled millings used in conventional asphalt plants is limited by the plants' design ability to withstand higher virgin aggregate process temperatures required to conduct sufficient heat to dry and heat the millings. Those extremely high temperatures can severely damage carbon steel dryer shells when exposed to temperatures of approximately 600 to 900° F. for extended periods.

For example, to recycle a 50% ratio of millings at 5% moisture content in a typical hot mix asphalt plant would require a virgin aggregate temperature of 904° F. to transfer sufficient BTU's of heat via conduction to achieve a final mix temperature 320° F. The radical and instantaneous explosion of steam generated from the moisture in the recycled millings, when contacting the super heated virgin aggregate, can be quite violent and difficult to contain.

Recycled millings should be heated by convection and conduction only, since radiation temperatures from the burner flame envelope are generally much too high, at approximately 2,400° F., for the asphalt to absorb without burning, smoking, coking and becoming hard and brittle. Recycling millings at more than 30% is not yet a clean, consistent and predictable science.

With new laws requiring the milling of road surfaces prior to paving, together with savings in natural resources of both aggregate and petroleum, it is apparent that there are immediate and ongoing needs for the development and implementation of technology capable of recycling 100% of millings into quality hot mix paving materials.

It is further apparent that current technology using super heated virgin aggregate to dry and heat the millings to paving mix temperatures is limited to an aggregate temperature level of 600° F. or less and is therefore inherently limited to using millings ratios of 30% or less in new hot mix paving.

The new technology and methods of the present invention utilize a unique indirect heating method with slow gradual and controlled temperature elevation in an oxygen deficient environment while keeping recycled millings in a turbulent mixing mode. Exclusive use of conductive and convective heat transfer methods only prevents high temperature thermal fracturing of the aggregate and coking damage to the liquid asphalt.

The present invention provides 100% utilization of recycled materials for new hot mix paving overlays in parking lots, driveways, primary and secondary road systems, highway berms, tennis courts, running and cycling tracks, hiking trails and any number of applications requiring pavement cover.

The process and apparatus of the present invention is constructed in either a stationary or fully mobile configuration.

A fully mobile configuration allows quick and efficient movement from one paving site to another. The fully mobile configuration also allows the machinery to move to recycled milling stockpiles, producing hot mix paving materials at various locations. The highly mobile process unit carries on board daily support utilities such as burner fuel, compressed air, electric power, water, liquid asphalt, rejuvenator, oil and sand.

The process system may be operated with or without hot mix asphalt storage silos. Having surge storage capacity of hot mix paving materials dramatically increases daily plant output capacity. The horizontal mobile silo that is included in the present invention is self-sufficient and carries the necessary burner fuel, electric power, compressed air, and controls for loading trucks. The silo unit receives either continuous feed from the process unit or batch feed with a weigh out scale to account for production tonnage. The silo is equipped with hot oil jackets and is insulated to prevent heat loss. The silo may be filled at anytime during plant operation and maintains hot asphalt for as long as 48 hours without cooling. The combination of the process unit and the hot storage unit expands the overall surge capacity of the process unit to deliver more tonnage to the paving crew during paving hours.

For example, the new process and apparatus is started at 5:00 am with an approximately 20 minute warm up, allowing the silo to be full at 7:00 am. The first round of trucks is quickly loaded and the process unit continually operates to refill the silo. The process unit continues to operate throughout the day until 7:00 pm at night when the silo is again filled. Paving begins again at 7:00 am the following morning with a warm up of approximately 20 minutes. The plant is able to put out approximately 1,160 tons of material for use with approximately 160 tons of additional material in storage for next day start up, for a total of approximately 1,320 tons per day output.

In this example, the productive capacity in tonnage during the paving window is approximately 116 tons per hour with the addition of the surge storage unit. At a capability of approximately 1,160 paving tons per day, the average sized RAP plant produces approximately 5,800 paving tons in a 5-day week. In an average paving year, for a plant in northern climates, it is possible to recycle at least 232,000 tons of recycled asphalt pavement.

The process unit and surge silo may be designed to operate over a wide range of production rates. Process units may be designed to operate at capacities from approximately 25 tons per hour to approximately 400 tons per hour or more. Mobile process systems are limited by size and weight to approximately 120 tons per hour. Transportable and stationary units may be designed to process approximately 400 tons per hour or more.

A milled pavement processing system of the present invention with a storage silo and load out system is capable of supporting a sizable paving market.

These and further and other objects and features of the invention are apparent in the disclosure, which includes the above and ongoing written specification, with the claims and the drawings.

DETAILED DESCRIPTION OF THE PREFERRED EMBODIMENTS

The present invention, herein referred to as "milled materials processor", consists of a thermal process plant for the thermal processing of 100% recycled asphalt pavement into new hot mix paving material. The milled materials processor may be a stationary process plant. In an alternative embodiment, the milled materials processor may be fully mobile or transportable.

The mobile embodiment is self-contained, transportable by truck or other vehicle to a job site and designed for quick arrangement. The standard legal load or non-permit load size generally calls for a maximum cube size of 8 feet wide×44 feet long×14 feet high from grade to top. These dimensions are critical if a unit is to adhere to a non-permit legal load status. The milled materials processing unit at this size and configuration processes approximately 25 tons per hour of pre-sized recycled asphalt pavement materials, approximately 50,000 lbs gross, having up to about 3% moisture content. Larger systems designed and built at approximately 10 feet wide×54 feet long and 12 feet wide×62 feet long require highway permits. Lengths may vary along with weight and height.

The key to achieving 100% asphalt pavement milling recycling lies in the ability to heat the millings gradually with low temperature conductive and convective heating to approximately 300° F.

Production materials for the present invention include any material that is suitable for fabrication, such as, but not limited to, A-36 carbon steel, stainless steel, NI hard, chrome carbide, AR 220, AR 440, Weldox 130, etc.

Figure 1:
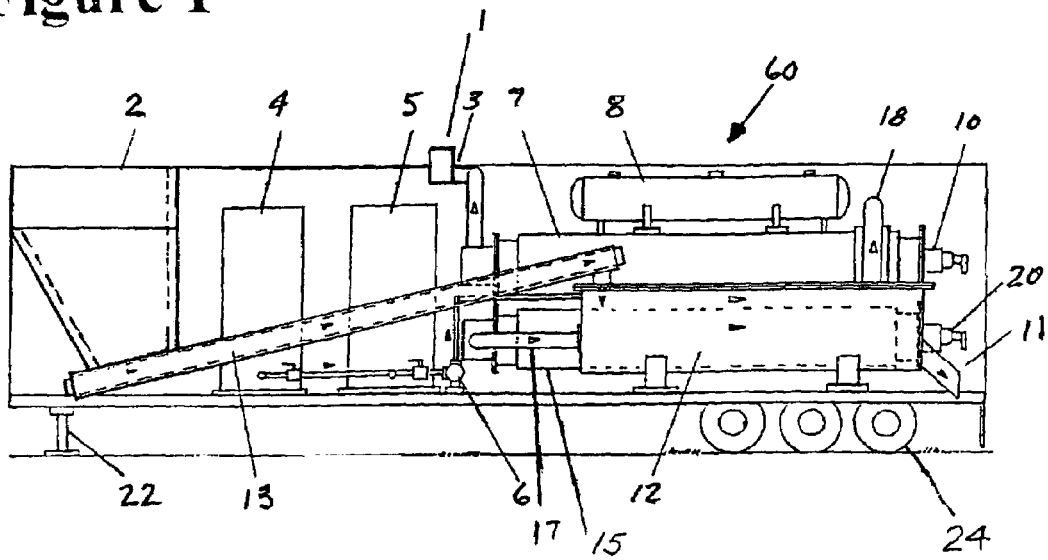
FIG. 1 is a left side elevation of the recycled asphalt milling process unit.
Figure 2:
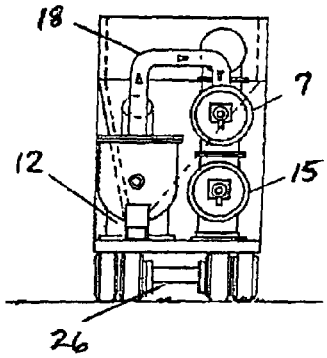
FIG. 2 is a rear elevation of the process unit shown in FIG. 1.
Figure 3:
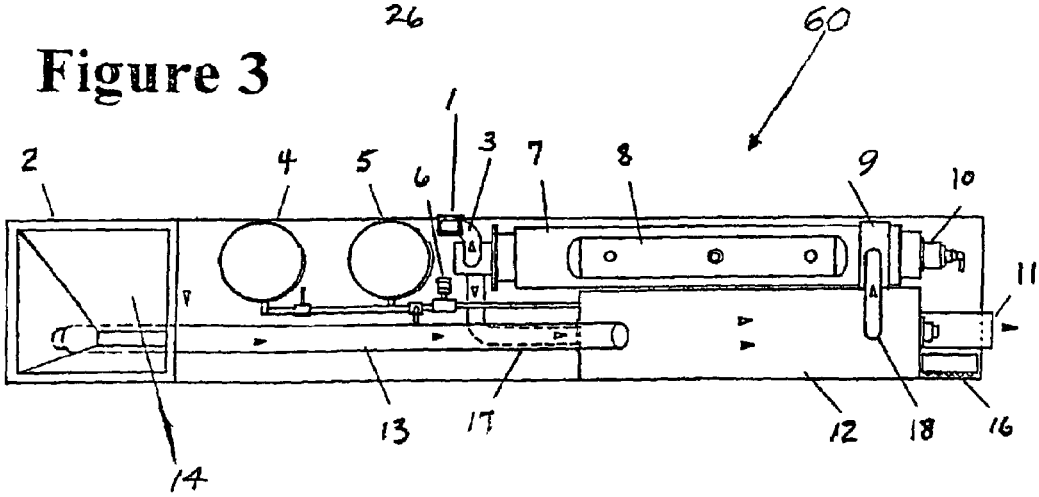
FIG. 3 is a plan view of the process unit from the top.

Referring to FIGS. 1-3, the burner combustion systems 10, 20 are used to gradually heat the indirect heat exchange fluid circulating in the exchanger coils and throughout the millings heating system. The gas combustion systems 10, 20 are unique types of non-oxidizing burners. The burners utilize, for example, but not limited to, #2 fuel oil, propane, electric or natural gas.

The burner produces a unique flame shape that is a well-defined narrow flame with extremely low flame luminosity at about 2,000° F. on gas. The burner blower supplies all air for combustion, however, the gas combustion systems 10, 20 are capable of using pre-heated, re-circulated, oxygen deficient air to enhance combustion and reduce $NO_x$ formation.

The heat transfer fluid, at temperatures of about 500 to 650° F., is pumped through the outer jackets of the mixer/heater unit 12 as well as the hollow screw flights of the feed screw conveyor 13 at pressures of about 40 to 60 psi. The heat exchanger fluid is pumped at the optimum velocity for conductive heat exchange, for example, approximately 7.0 feet per second. Standard heating equipment may be used with approximately 400° F. heating fluid instead of higher temperature heating fluids. In order to use these lower temperature heating fluids, the size of the equipment is increased to allow for increased heat transfer to the materials in order to raise the material exit temperature to the preferred temperature of approximately 300 to 320° F. Other heat transfer fluids may be used. Much higher temperature heating fluids may be used, for example, but not limited to, liquid salt at approximately 1,200° F. Other final material exit temperatures are possible. This is ideal for materials such as "warm patch", "cold patch" or other products.

The delta T between material exit temperature at approximately 300 to 320° F. and the heating fluid is optimized at a difference of approximately 250° F. Other values for delta T require changes in the size of the heater augers.

Heated exhaust gas exiting heat exchanger B 15 is directed into the air cavity of the mixer/heater 12 to provide additional BTU heat input for convective heat transfer while flashing off moisture and removing it from the inside of the auger. Gases that exit the mixer/heater 12 via hot gas pipe 18 are directed to the air cavity of mixer/heater 333 and then to thermal oxidizer inlet 9 of heat exchanger A 7 for thermal oxidation in the burner combustion chamber.

After passing through heat exchanger A 7 the clean reheated gasses may be stacked to atmosphere.

The millings are gradually fed via conveyor into the inlet of the primary mixer/heater. When the millings enter the mixer/heater unit, they are wet and at ambient temperature. The primary heated auger dries the wet RAP and achieves an overall discharge temperature of about 175 to 200° F.

The secondary jacketed mixer/heater provides the final heating stage for the millings, elevating the temperature to a range of approximately 300 to 320° F., which is the required hot mix temperature for paving.

Figure 13:
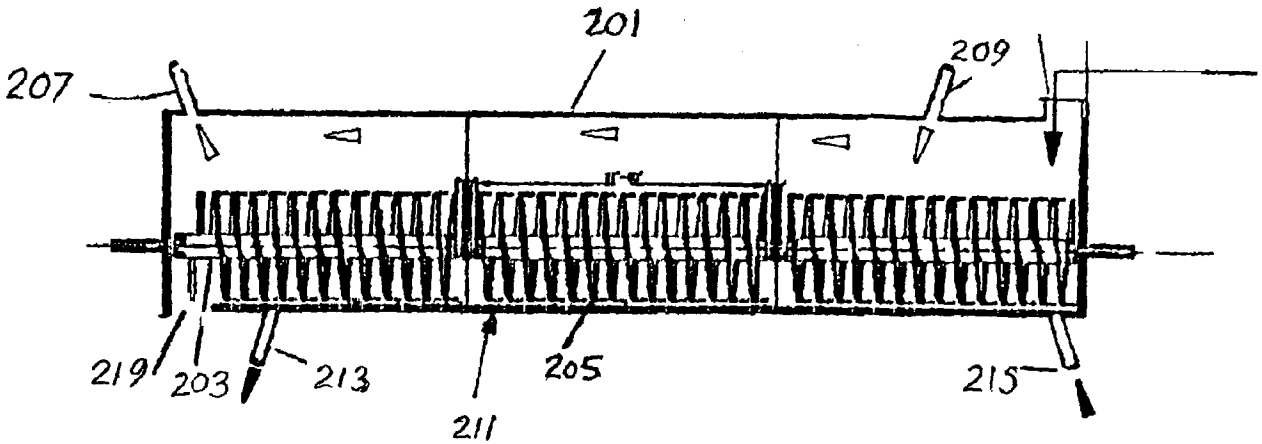
FIG. 13 is a side view of the hollow screw auger.
Figure 14:
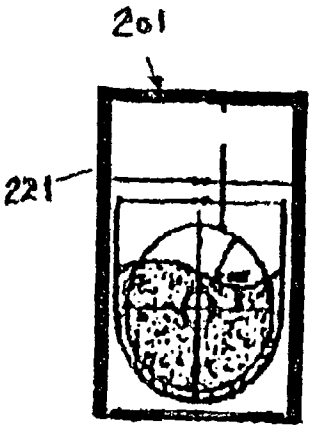
FIG. 14 is an end view of the hollow screw auger.

In a preferred embodiment, the mixer/heater is a hollow screw auger with a heated shaft 203 and heated blades 205, as shown in FIGS. 13 and 14. The hollow screw auger 201 results in a larger heat surface area than a pugmill type of mixer/heater unit 12 with paddles and arms. The hollow auger 201 has better conductive heat transfer and increased output. The hot oil flow pattern in the auger and the unique shaft oil seals along with the built in flow diverter baffle system. The hollow screw auger 201 has a hot air inlet 209 and a hot air outlet 207. The hot air moves in a direction parallel to the flow of materials. Hot oil enters a jacket 211 through a hot oil inlet 215 and exits through a hot oil outlet 213. The hot oil also moves in a direction parallel the flow of materials through the hollow screw auger 201. The milled asphalt enters the auger 201 through an inlet 217 and exits through an outlet 219. An insulation jacket 221, for reducing heat transfer to the surroundings, surrounds the auger 201.

The screws are preferably, but not limited to, 24", 36", 48", 60", or 72" in diameter by any desired length. Other intermediate sizes are possible, as well as larger and smaller diameter depending on the application. In a preferred embodiment, a screw is 48" in diameter by 24' in length. Length is determined by shaft bearings at each end of the trough and spanning extremely large distances is generally not practical, although possible.

When the milled materials processor 60 is located at the paving site, the mix is not subjected to long truck hauls. Hauling cools the plant mix temperatures making paving, raking and compacting more difficult for the paving crew.

In a preferred embodiment, the mixer/heater has an approximately 48" inside diameter and is 36' long. Four units are placed in series per trailer. Other sizes and arrangements are possible. The outside of the mixer is covered with 3" of insulation to assure that approximately 94% of the available conductive heat is transferred to the recycled asphalt millings. In conjunction with conductive heating from the hot fluid jackets within the mixer, additional heated exhaust gas from heat exchanger B 15 is also directed into a primary mixer/heating chamber 12 through hot gas pipe B 17. Convective heat from the exhaust gas, emitting from heat exchanger A 7 at approximately 850° F., and conductive heat slowly increase the temperature of the millings. Liquid asphalt is moved through the system by an asphalt pump 6. The millings are exhausted through the mixer discharge 11.

As the hot exhaust gas, at about 850° F., transfers convective energy to the millings, in both the primary and secondary augers, the exhaust vapors will absorb moisture along with light end petroleum fumes that are generated from the reheating process. However, 100% of the exhaust gas that is directed into both of the mixer/heaters 12 is removed via the hot gas feed pipe 18 and is then directed to the thermal oxidizer inlet chamber 9 on the oxidizer heat exchanger A 7. As the gases enter the combustion zone inside the heat exchanger, they are instantly consumed as fuel for the gas combustion system 10. Therefore, only exhaust gases that have been thermally oxidized are permitted to exit the process at stack 1.

Control panel 16 regulates the system.

The apparatus and process of the present invention are intended for, but not restricted to, a mobile device. Other configurations include: a stationary setup, a skid mounted configuration and a modular configuration that is transportable. The milling process unit 60 is set on wheels 24 and axels 26. Once at the appropriate location, self-storing blocking systems 22 are deployed to stabilize the system. The unit as described in the examples has a capacity of approximately 25 tons per hour to approximately 400 tons per hour or more. The system is designed and constructed in any size that is required in either a stationary or mobile setup.

Figure 4:
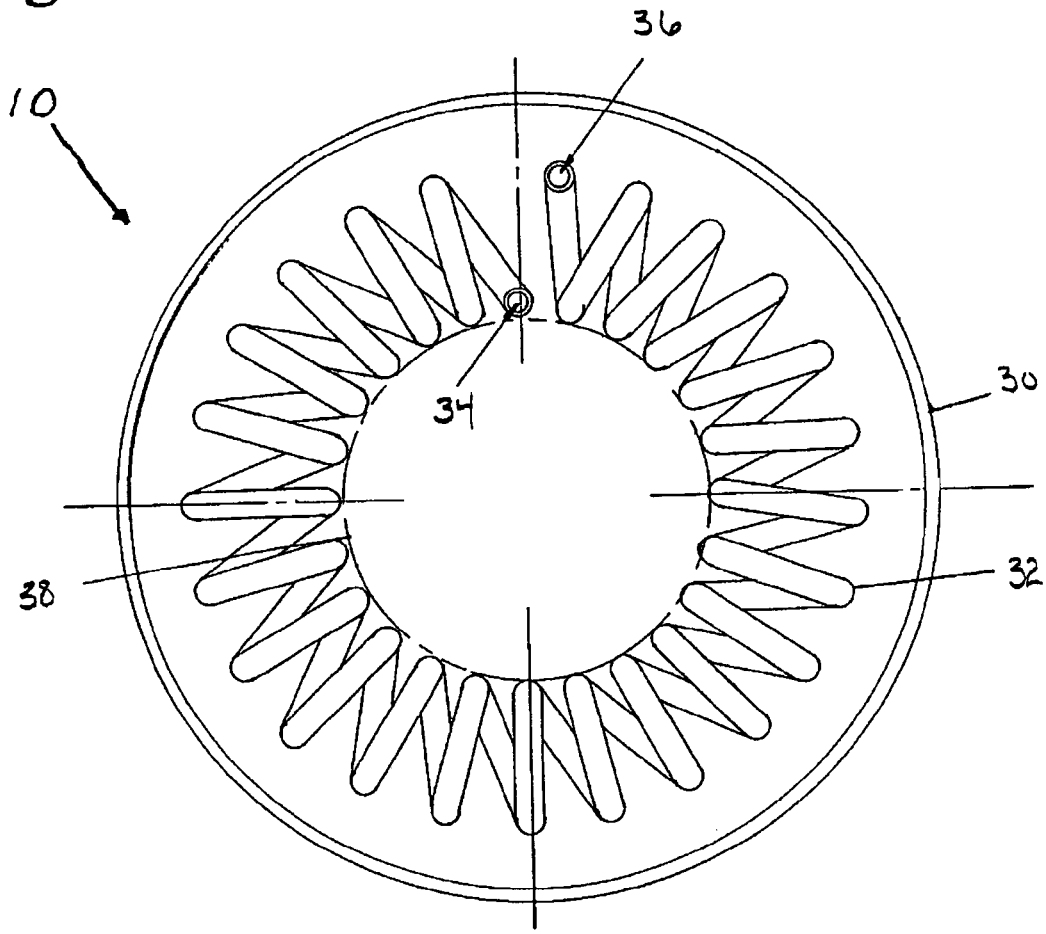
FIG. 4 is a cross sectional view of a heat exchanger with a coil for heating a heat transfer fluid.
Figure 5:
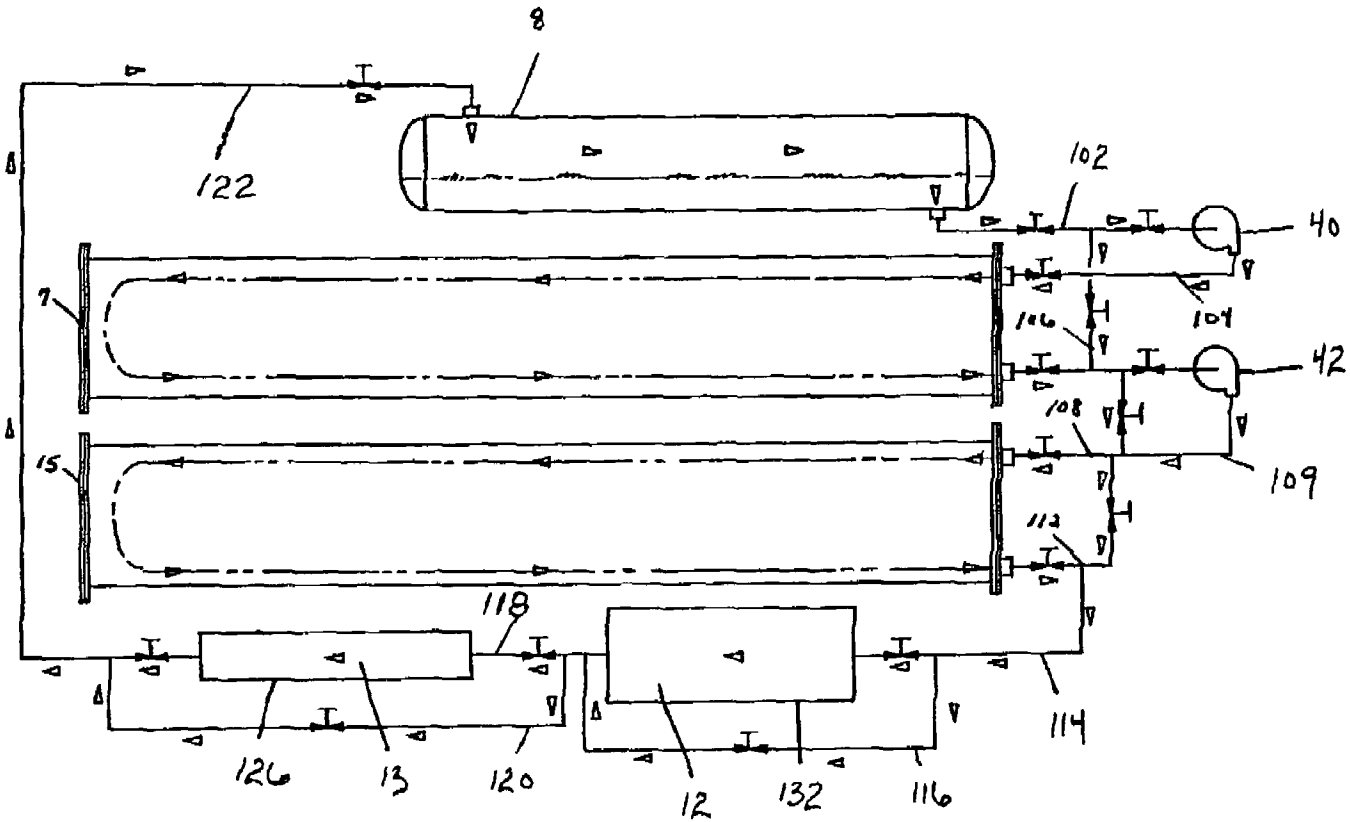
FIG. 5 is a schematic of the heat transfer piping system and indirect heating circuit.
Figure 6:
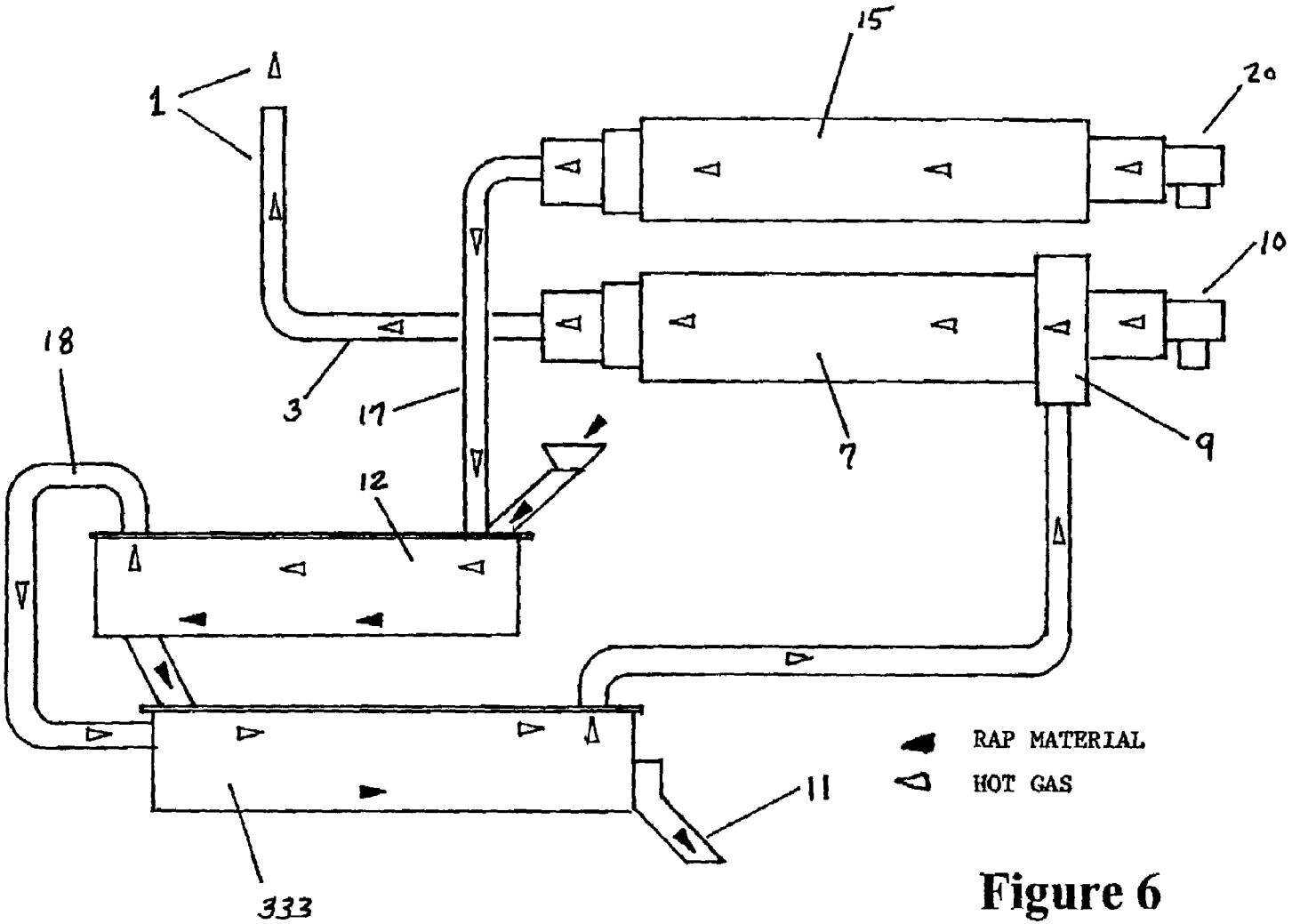
FIG. 6 is a schematic heat balance for the recycled milling system.

FIG. 4 shows the details of the indirect heating element. The system utilizes a heat exchanger fluid as the primary heat transfer medium. The heat exchanger fluid is pumped through two approximately 40" diameter×36' long, fired, tube type, heat exchangers 7, 15 each having up to approximately 1,440 lineal feet of 2" pipe coil 32. A shell 30 that contains the pipe coil 32 surrounds the indirect heating element. A combustion chamber with burner is located on one end of the exchanger. The pipe coil has a heat exchanger fluid inlet 34 and outlet 36.

In FIGS. 5-8, two centrifugal chemical pumps 40, 42 are used to pump the heat exchanger fluid from the pressurized expansion tank 8 to both primary and secondary heat exchangers. The heat exchanger fluid exits at about 650° F. and is pumped through the augers at a flow rate of approximately 85 gpm at 65 psi. Pumps are preferably magnetic drive pumps, conventional centrifugal pumps, or positive displacement pumps, depending on the application. Other types of pumps may be used if needed.

A pressurized oil system is used for efficiency and to assure that there are no emissions from the heat exchanger system. Alternatively, an atmospherically vented system is used. Both systems have advantages in different applications.

Heat exchanger fluid is moved from the pressurized expansion tank 8 through pipe 102 to chemical pump 40 and on to heat exchanger A 7 or is bypassed through pipe 106 to the outlet 108 of heat exchanger A 7. Hot heat exchanger fluid is pumped by pump 40 through pipe 104 into heat exchanger A 7. Heat exchanger fluid discharged from heat exchanger A 7 is pumped through pipe 108 by pump B 42 to heat exchanger B 15 or is bypassed around pump B 42 through pipe 110. Heat exchanger fluid is pumped through pump B 42 and into pipe 109.

The heat exchanger fluid is then pumped through pipe 109 into heat exchanger B 15 or bypassed through pipe 112 to the discharge 114 of heat exchanger B 15. The effluent of heat exchanger B is moved through pipe 114 into the jacket 132 surrounding the mixer/heater 12.

There is a bypass 116 around the mixer/heater 12. Heat exchanger fluid is bypassed from pipe 114 and is reintroduced into pipe 118 at the discharge of the mixer heater 12.

The recombined heat exchanger fluid leaving the mixer/heater 12 is pumped through pipe 118 into the jacket 126 of the feed auger 13. There is a bypass pipe 120 around the feed auger 13. The mixed discharge from the feed auger jacket 126 and the bypass 120 are mixed to form stream 122 that flows back toward the pressurized expansion tank 8.

Figure 7:
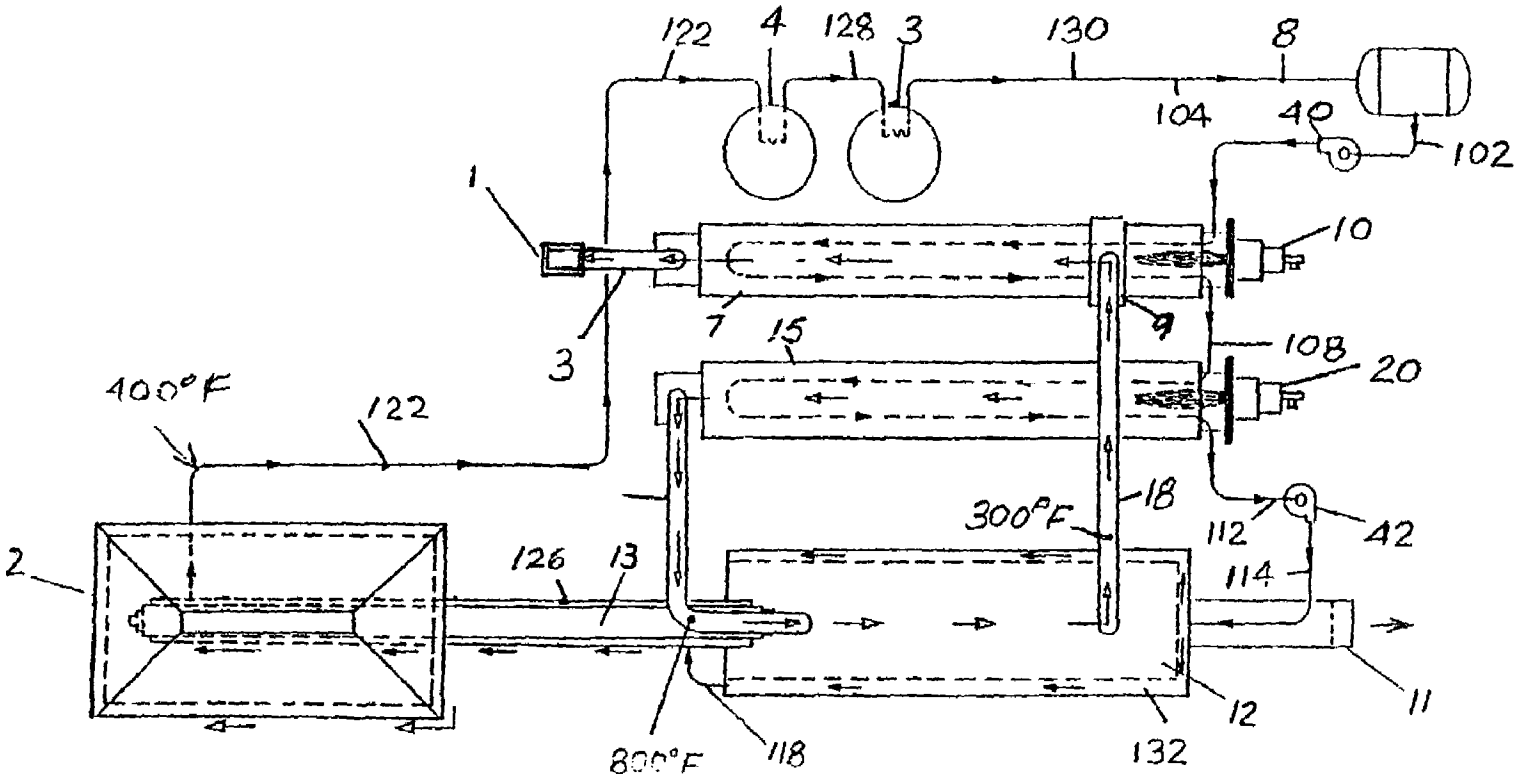
FIG. 7 is a schematic flow diagram of the gradual hot chemical heating and the hot gas heating.
Figure 8:
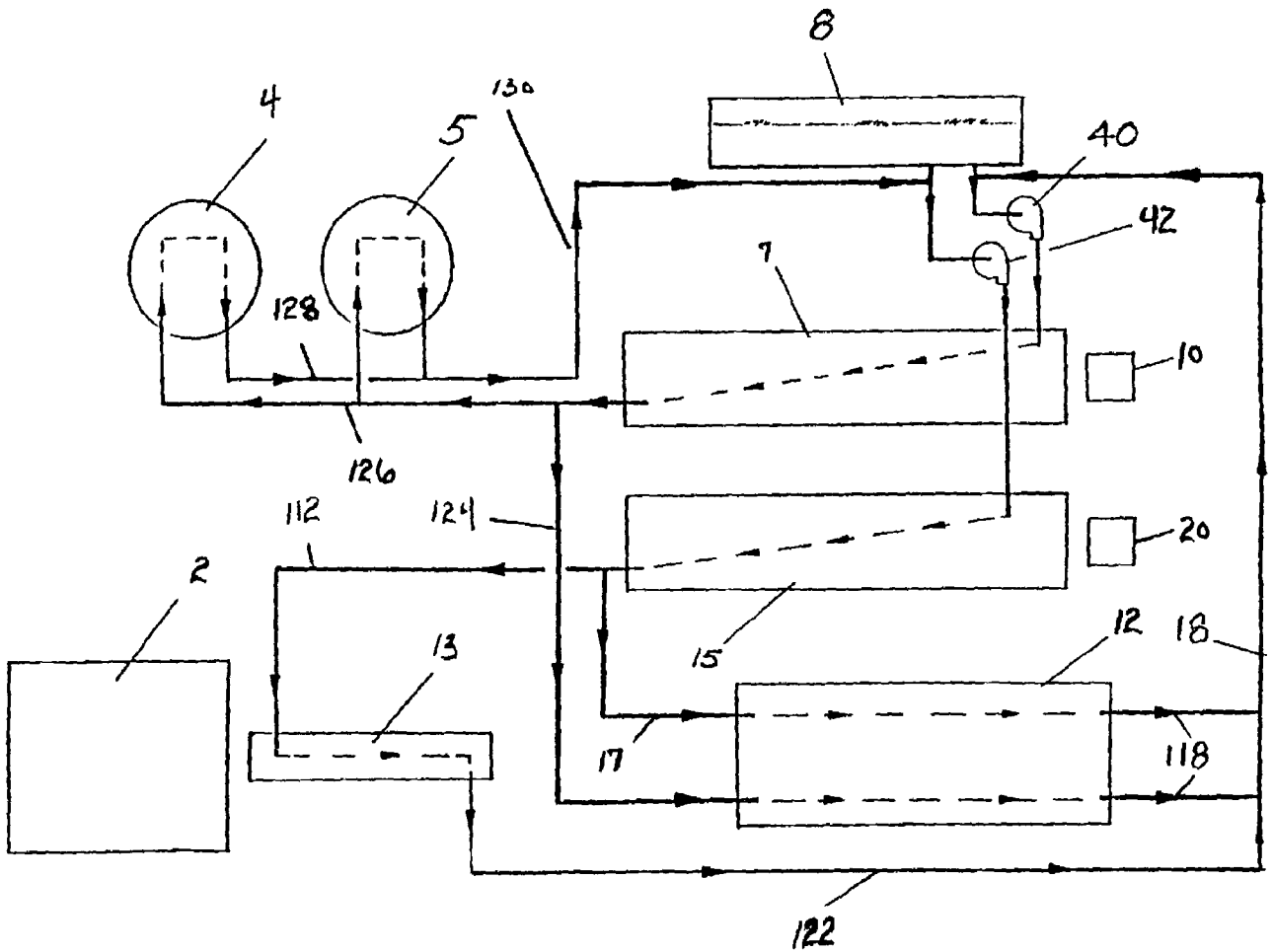
FIG. 8 is a schematic flow diagram of the heat transfer fluid.

Referring to FIG. 7 and FIG. 8, prior to arriving at the pressurized expansion tank 8, the pipe 122 connects with the asphalt tank 4. After passing through the asphalt tank 4, the oil passes through a pipe 128 and into the rejuvenator tank 5. Finally, the oil exiting the rejuvenator tank 5 moves through a pipe 130 and back to the expansion tank 8.

The process unit 60 is designed to operate independently or in conjunction with a surge silo system 62, which can be used to store the finished hot mix asphalt for a period of up to 48 hours without cooling. Horizontal surge silos 62 are available in a number of sizes from approximately 72 to approximately 160 tons capacity. Having a surge silo 62 to store material allows the process unit to run on a continuous basis. Otherwise, the process unit has to interrupt production based on demand at the paving site. If trucks are not always available for loading, a plant must shut down, or material is dumped on the ground and picked up again with front-end loaders.

When process unit 60 is located at the paving site, it is feasible to work directly from the process unit to the paving mat using loaders or shuttle buggies to carry material away from the unit to the paver.

The Milling Materials Processor Unit Operation:

The unit 60 is transported to the production site and is leveled and blocked for operation. If a surge silo 62 is to be used with the process unit, it is set and blocked. A vertical screw lift conveyor or drag slat 66 is set in place to carry the hot mix from the process plant to the storage and load out silo. Once the silo 62 and process unit 60 are placed and the transfer conveyor 66 is installed, the system is ready to begin warm up. The generators are warmed up slowly and after a sufficient time are brought to full operational capacity. Maximum electric power is then at all components.

Heat Exchanger Operation:

Operation of the heat exchangers begins with turning on both main circulating pumps 40, 42. The system pressure is steady and has a minimum of about 40 to 60 psi. The hot oil may be quite warm from previous use and warm up time may be short. The hot fluid is brought to a temperature of approximately 550° F. to approximately 600° F. Jacketed surfaces heat very quickly and within approximately 15 minutes the unit is ready to accept recycled asphalt pavement feed.

Jacketed Mixer/Heater:

The mixer/heater 12 is sealed, fully jacketed and completely insulated to conserve energy and drive all available heat into recycled asphalt milling mix. The mixer/heater 12 also receives the benefit of hot gases from a heat exchanger 15 that heat the millings by convection. The mixer/heater has a large central drive shaft that contains heated hollow auger flights 205, which sweep the material against the heated sidewalls of the mixer. The central shaft and the hollow auger flights are also heated by hot fluid.

As the millings progresses through the mixer/heater 12, a small amount of liquid asphalt and/or liquid rejuvenator may be injected into the material. A problem with the use of RAP in recycling is the need to replace light end constituents lost during the original hot mix manufacturing process. Additionally, some of the RAP is badly "weathered" and thus dry and sun baked. This leads to the asphalt becoming extremely hard and brittle with a carbonized outer surface that is difficult for even heat to penetrate. The rejuvenator liquids blend and integrate with the old asphalt as it liquefies to enhance the asphalt binder, restoring the majority of its original characteristics. Injecting and mixing a chemical rejuvenator into the post-heating zone of the process replaces the light end materials and aids in controlling the viscosity for proper compaction and stabilization. As the rejuvenator contacts the old asphalt, it is broken down into liquid that aids in coating ability and enhances material workability at the paving site.

The millings dwell within the mixer/heater 12 for approximately 6 to 12 minutes before discharging. The central shaft within the mixer/heater 12 is driven by a variable speed motor drive and is adjusted to any rotational speed required for maximum dwell efficiency. Variable speed motors starters allow a wide range of throughput capacity and variable dwell times. As RAP moistures and ambient temperatures change, more or less dwell time is required to achieve finished mix temperatures. Different types of paving grades, such as base, binder, wearing course, etc., also require different dwell times to achieve final mix temperature.

Figure 9:
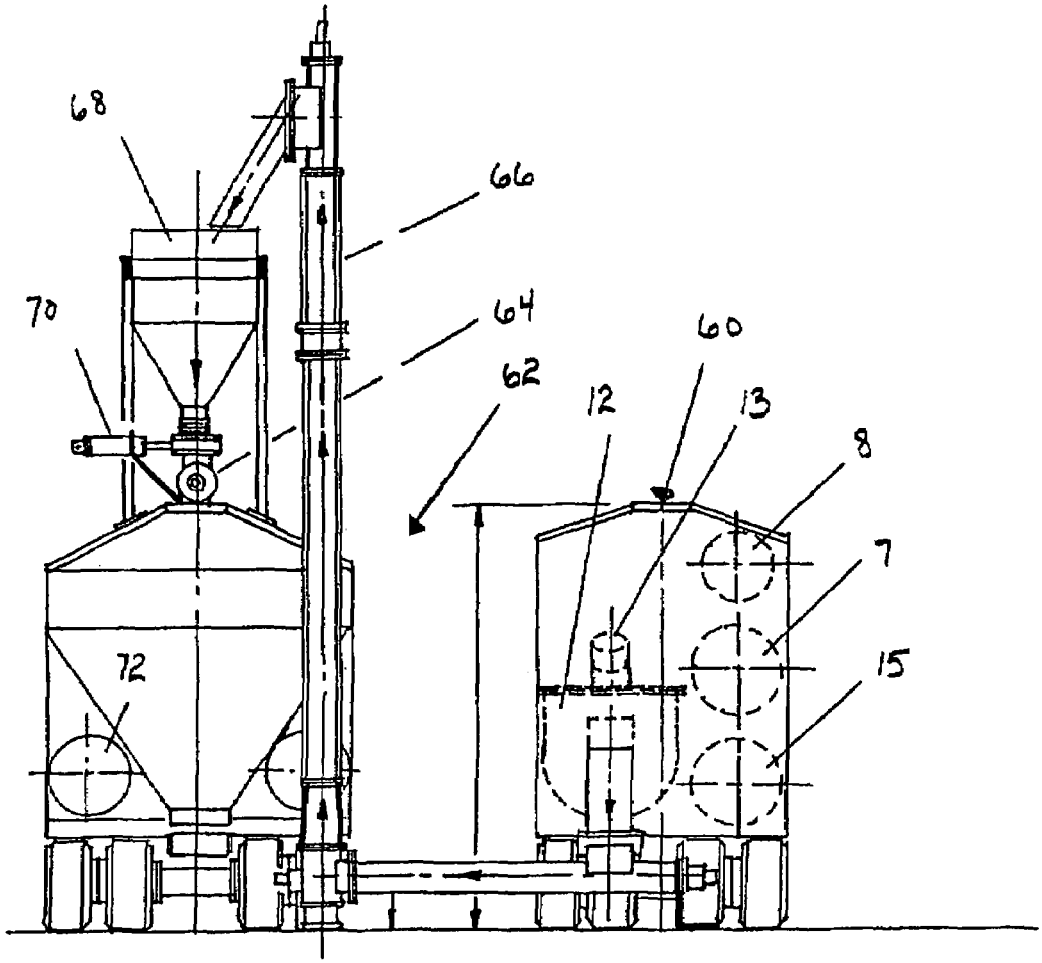
FIG. 9 is an end elevation diagram of the complete process unit and silo.

Horizontal Mobile Heated Surge Silo:

Referring to FIG. 9, when a silo is used in conjunction with the process unit, a drag slat or a screw lift conveyor 66 is used to transfer the hot mix from the processing unit discharge chute 11 into the silo distribution auger 64, used to load the silo 62. The silo 62 is fitted with a slug feeder or load cell mounted batcher in order to weigh and totalize all incoming material fed to the silo 62 from the process unit 60. The batcher 68 will automatically fill, stop the feed auger 64, weigh the batch, log the data and then automatically start the conveyor 66 again. Other types of silos may be used, such as, for example, vertical self-erect surge silos or even stationary storage silos.

Figure 10:
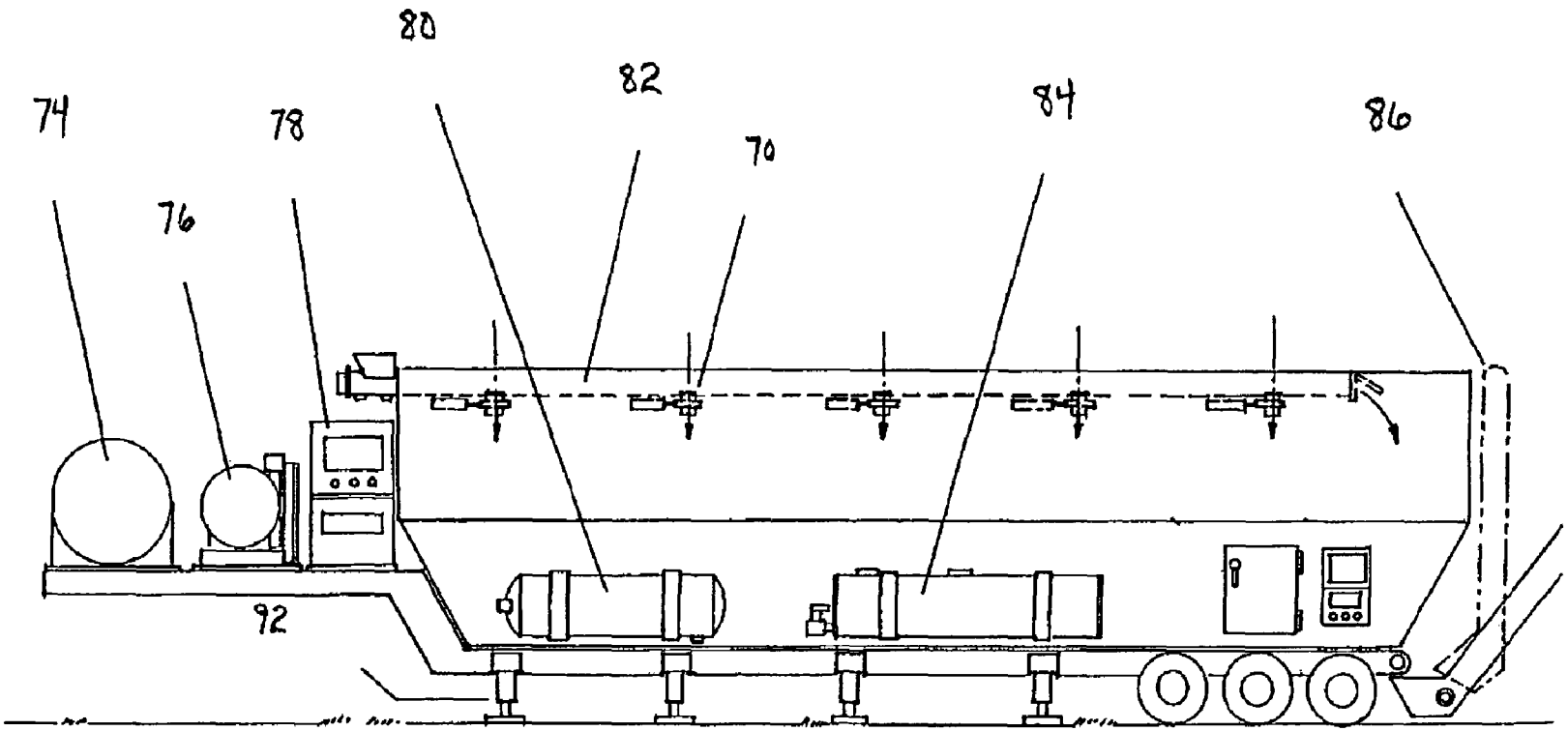
FIG. 10 is a left side elevation of the horizontal surge silo.
Figure 11:
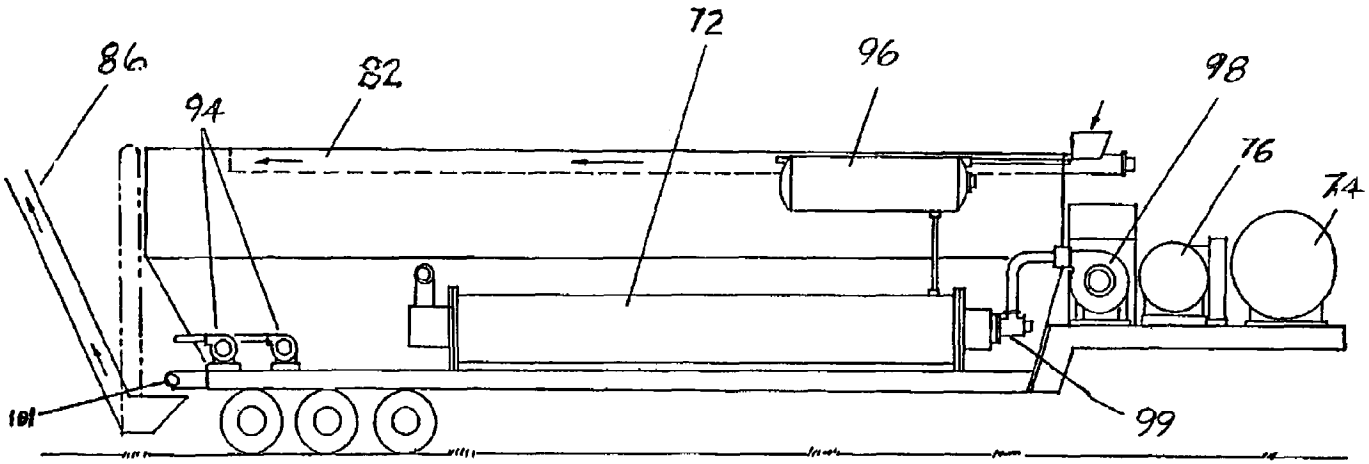
FIG. 11 is a diagram of the right side elevation of the horizontal surge silo.
Figure 12:
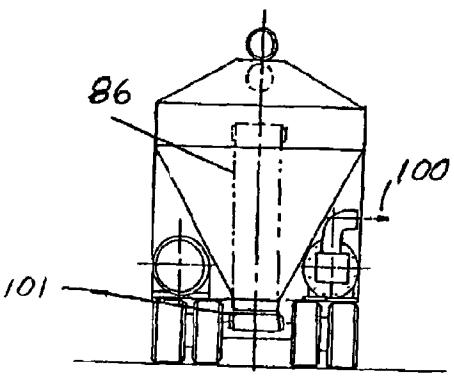
FIG. 12 is a rear view of the horizontal surge silo.

In FIGS. 10-12, the distribution screw conveyor 82 that loads the silo has six drop ports evenly spaced along its length. Each drop port is equipped with an air actuated knife gate 70 with a solenoid operated air cylinder triggered by pulse cycle board. The pulse board is preprogrammed for any drop sequence and valve open time that is required. Thus, the silo 62 is evenly loaded without segregation.

A load relieving retention baffle runs the length of the silo hopper and is positioned over the unloading belt conveyor. The baffle acts as a bridge to support the majority of the load weight above the unloading conveyor. The silo 62 contains its own diesel-powered generator 78 and fuel oil 84 as well as the gaseous fuel 74 for the propane fired heat exchanger 72 that heats the hot fluid for the silo jackets. The silo 62 also contains an air compressor 76, air receiver tank 80, motor starters 88, and control panel 90.

The heat exchanger system includes hot oil pumps 94, a hot oil expansion tank 96, burner blowers 98, burner 99 and heat exchanger exhaust 100.

Horizontal surge silos 62 are designed in mobile configuration in sizes of approximately 75, 125, and 165 tons. Other sizes and configurations are possible. Units above 75 tons require permits to move. As with the process unit 60, the horizontal surge silo 62 may be mobile and has self-storing blocking 92. The silo 62 may be equipped with a truck loading slat 86 and a conveyor 101 to discharge the millings from the horizontal surge silo 62.

The mobile configurations and the stationary configurations operate in similar manners. The components are similar and the operation is similar. Differences include output capacity and characteristics needed for mobility. The present invention is equally useful for stationary applications as mobile applications. The advantages of the present invention over the prior art become even more apparent when the present invention is compared to existing milled materials processor plants.

Figure 15:
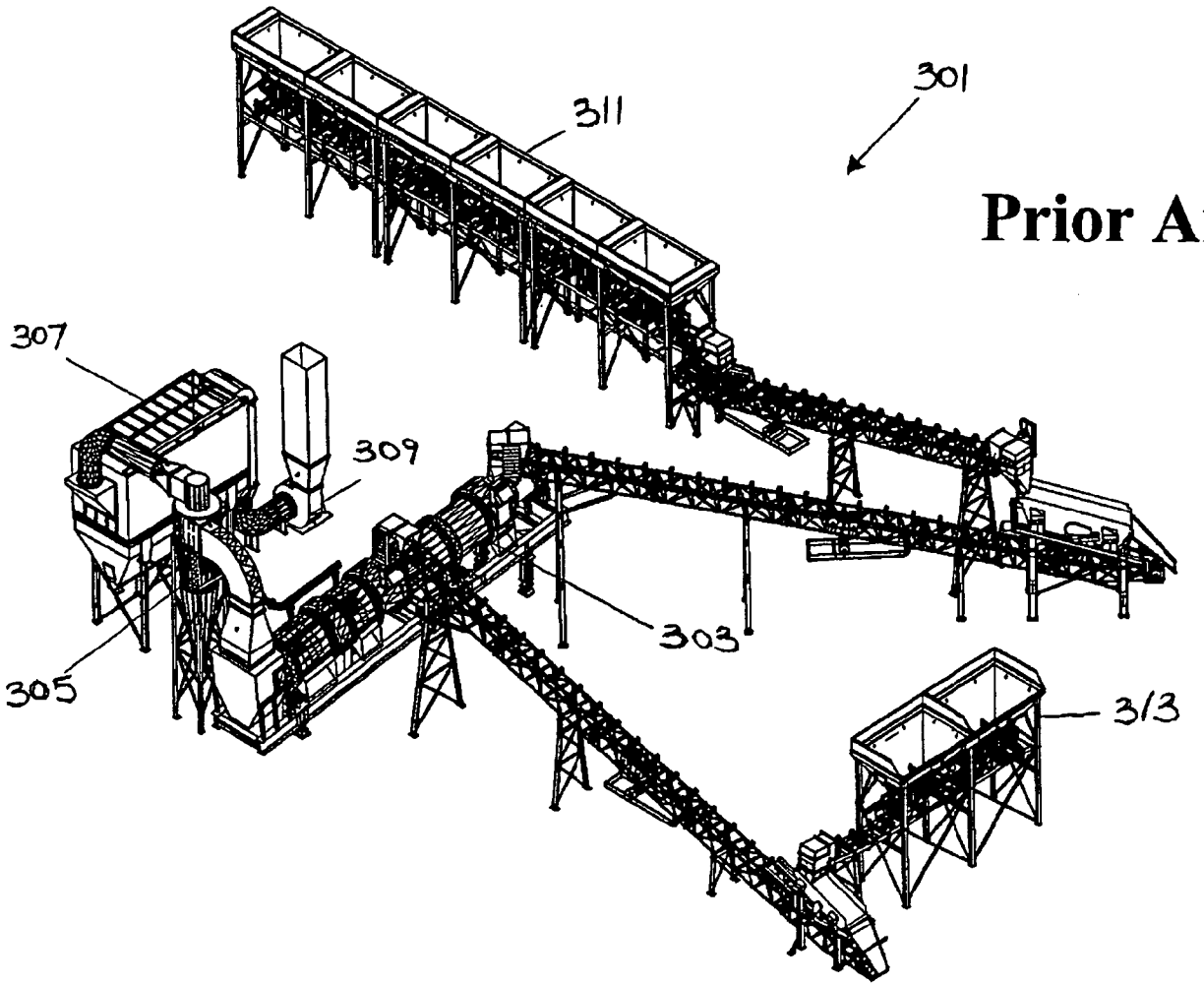
FIG. 15 is a plant layout view of existing asphalt processing plants.

FIG. 15 is a plant layout view of a sample existing asphalt processing plant 301. Existing systems are complicated and expensive operations. The milled materials processor plant of the present invention completely replaces existing systems. The present invention eliminates rotary driers 303, dryer burners, ducting, primary dust collectors or cyclone dust collectors 305, bag house fabric filter secondary dust collectors 307, dust augers, dust air blowers, exhaust fans 309 and dust silos. The present invention may require an aggregate feeder 311 when used in a virgin hot mix production mode along with RAP from a RAP feeder 313.

The cost associated with existing systems is larger, due in part to more components. Typical asphalt plants have many additional components, roughly triple the HP, large complicated dust handling systems, and large aggregate feeder systems. Typical plant costs are between about $2,000,000 and about $3,000,000.

In contrast to existing systems, the present invention is quiet, dust free, odor free, emissions free, low HP, low energy consumption, low initial cost, easily set up, highly portable, low maintenance, and expandable at any time. Typical plant costs for the present invention are roughly half the price of existing systems. Because of the decrease in startup and operations costs the product from the present invention is significantly cheaper than comparable existing systems. Savings in liquid petroleum (asphalt) alone make the present invention economically feasible. Furthermore, processing and separation of RAP into various sizes, such as fines, ¼", ½", ⅜", ¾" and other sizes, controls the quality of the finished mix design. Isolating the RAP fines and controlling the injection volume rate controls the finished liquid content.

Another crucial aspect of the present invention is the ability to function as a virgin hot mix asphalt plant and process. Drying and heating virgin aggregate to approximately 300° F. and then injecting liquid asphalt creates virgin hot mix asphalt. Furthermore, reducing the temperature of the heating fluid creates "warm patch" or "cold patch". The present system may create a combination of virgin aggregate hot mix by using a percentage of RAP injected into the mixture. Any combination of ratios is possible.

Figure 16:
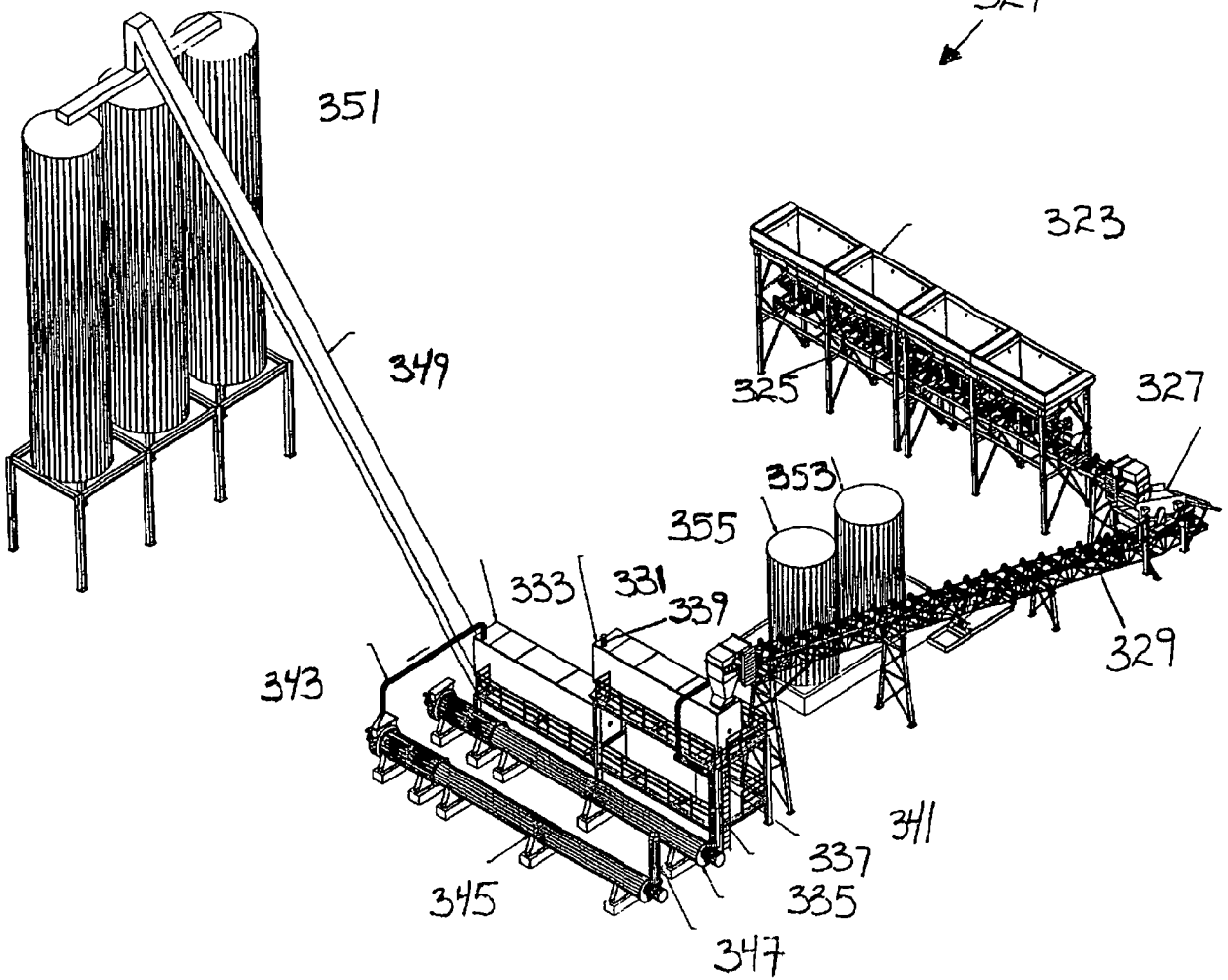
FIG. 16 is a plant layout view of the present invention.

FIG. 16 is a plant layout view of a stationary milled materials processor plant 321 of the present invention. RAP is fed into RAP bins 323 with variable speed feeders. A feeder conveyor 325 carries the RAP to an oversize screen 327 for sorting and removing large objects from the RAP. A second conveyor 329 then carries the RAP to a primary RAP heater 331. An M.C.C. enclosure 341 supports the system. The RAP then passes through the primary RAP heater 331 and into a secondary RAP heater 333. Hot air from a primary oil heater 335 passes into the primary RAP heater 331 through a hot air inlet pipe 337 and exits through an exhaust port 339. Continuing into secondary heater 333, hot air from the secondary RAP heater 333 passes through a hot air exhaust pipe 343, exits through pipe 343 and into a secondary oil heater 345. The hot air is exhausted through an exhaust stack 347. Material flows from the secondary RAP heater 333 and into a drag slat conveyor 349. The drag slat conveyor 349 carries the material to one or more heated RAP storage silos 351.

Fuel oil storage 353 and rejuvenator storage 355 are located onsite and connected to the system at the necessary stages.

Figure 17:
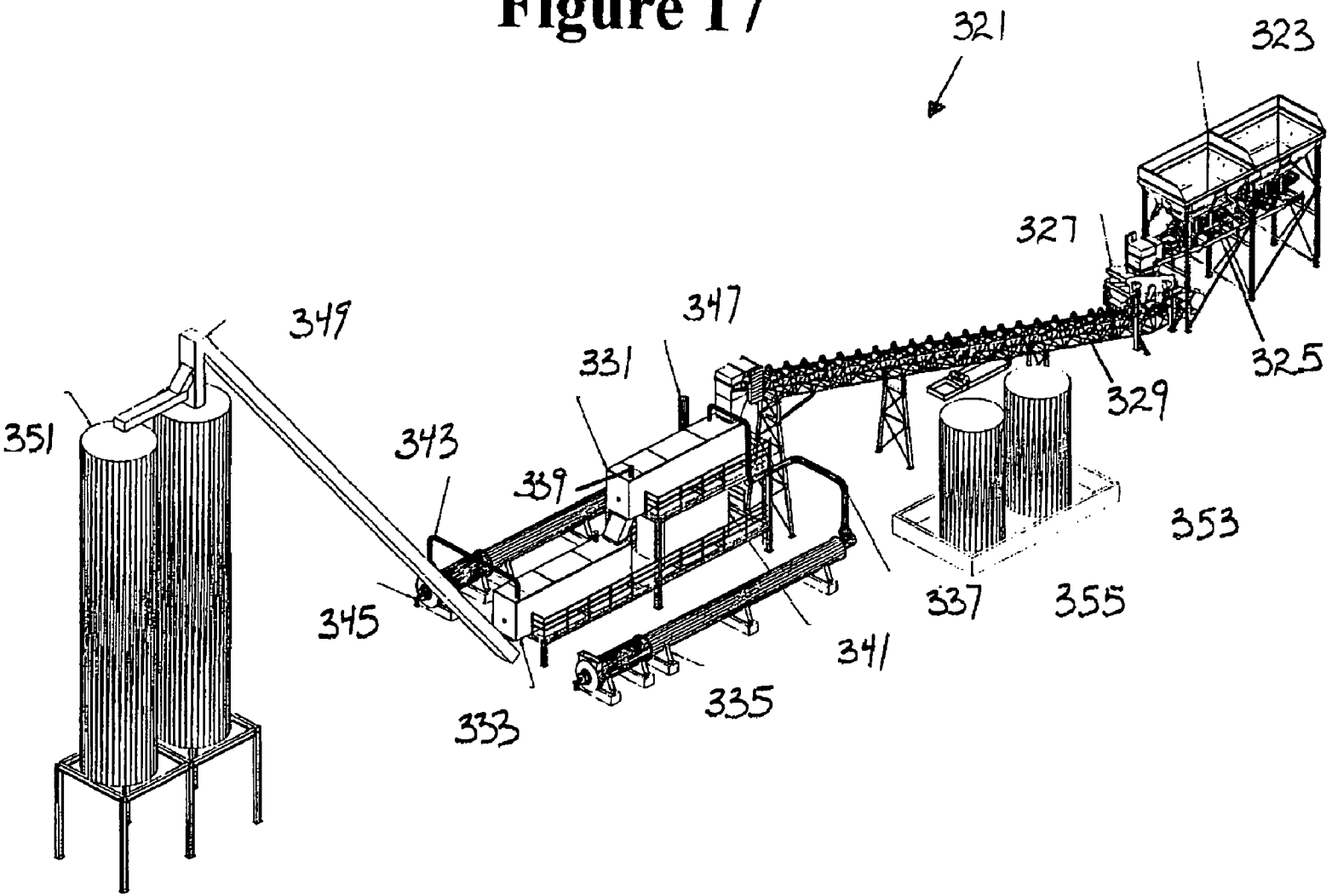
FIG. 17 is an alternative plant layout view of the present invention.

FIG. 17 is an alternative plant layout view of a stationary milled materials processor plant 321 of the present invention. Many different configurations of plant design are possible depending on user need, land restrictions and available space.

Figure 18:
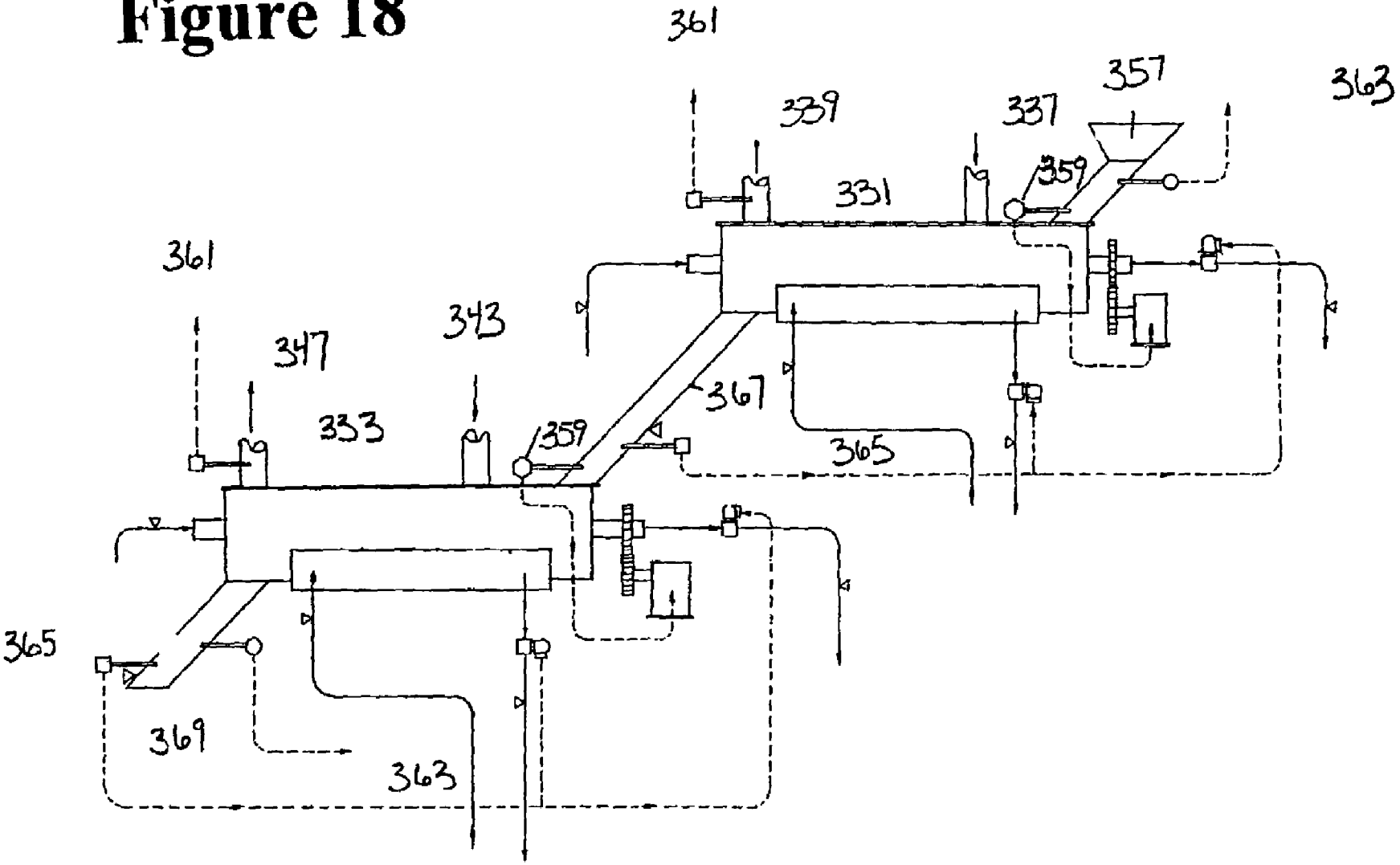
FIG. 18 is a control function schematic of the milled materials processor.

FIG. 18 is a control function schematic of the milled materials processor 321. RAP enters the primary RAP feed 331 through a RAP feed 357. Sensors include overflow limit sensors 359, sweep gas exit temperature sensors 361, no flow alarms 363, temperature probes 365. Material is transferred from the primary RAP feed 331 to the secondary RAP feed 333 by a transfer channel 367. Finished hot mix is removed from the secondary RAP feed 333 through an exit channel 369.

In alternative embodiments, standard off the shelf hot oil heaters may be substituted for the multiple direct-fired tube in tube heat exchangers described above.

Figure 19:
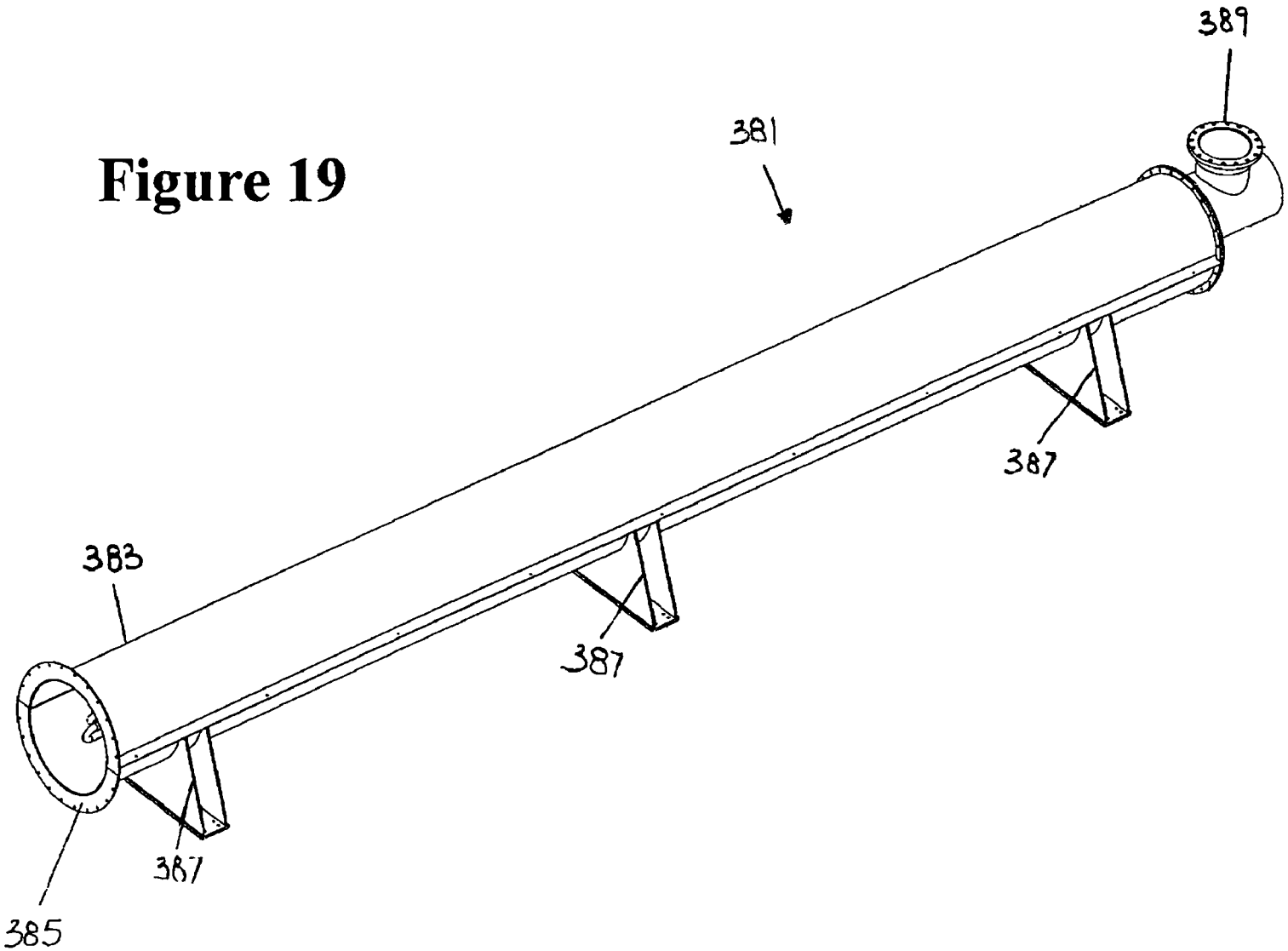
FIG. 19 is a perspective view of a heater coil section.

FIG. 19 is a perspective view of a heater coil section 381 with a clamshell cover 383. The heater coil section 381 includes a connection 385 for connecting to a combustion chamber and a connection 389 for connecting to a hot air pipe opposite the combustion chamber. Footings 387 provide a stable platform for the heater coil section 381. Various configurations and variations on the cover 383, footings 387 and connections 385, 389 are possible. The invention is not limited to the embodiment shown.

Figure 20:
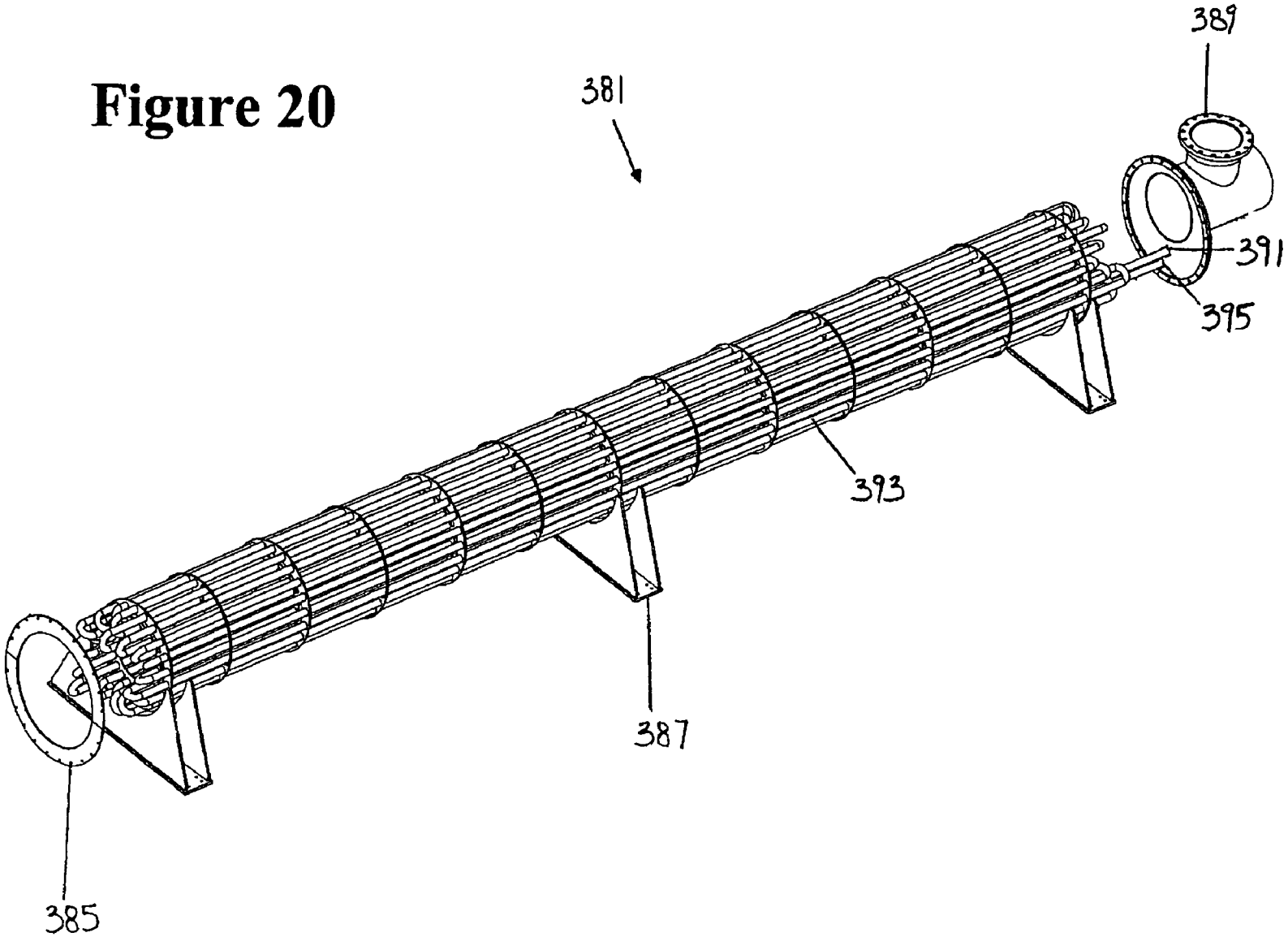
FIG. 20 is a cutaway view of the heater coil section without the outer shell.

FIG. 20 is a cutaway view of the heater coil section 381 without the outer shell 383. Oil enters the heater coil section 381 through an inlet 391 and is heated by hot air within the heater coil section 381. The coil tubes 393 are would through the heat exchanger 381 and the oil exits through an outlet 395.

Figure 21:
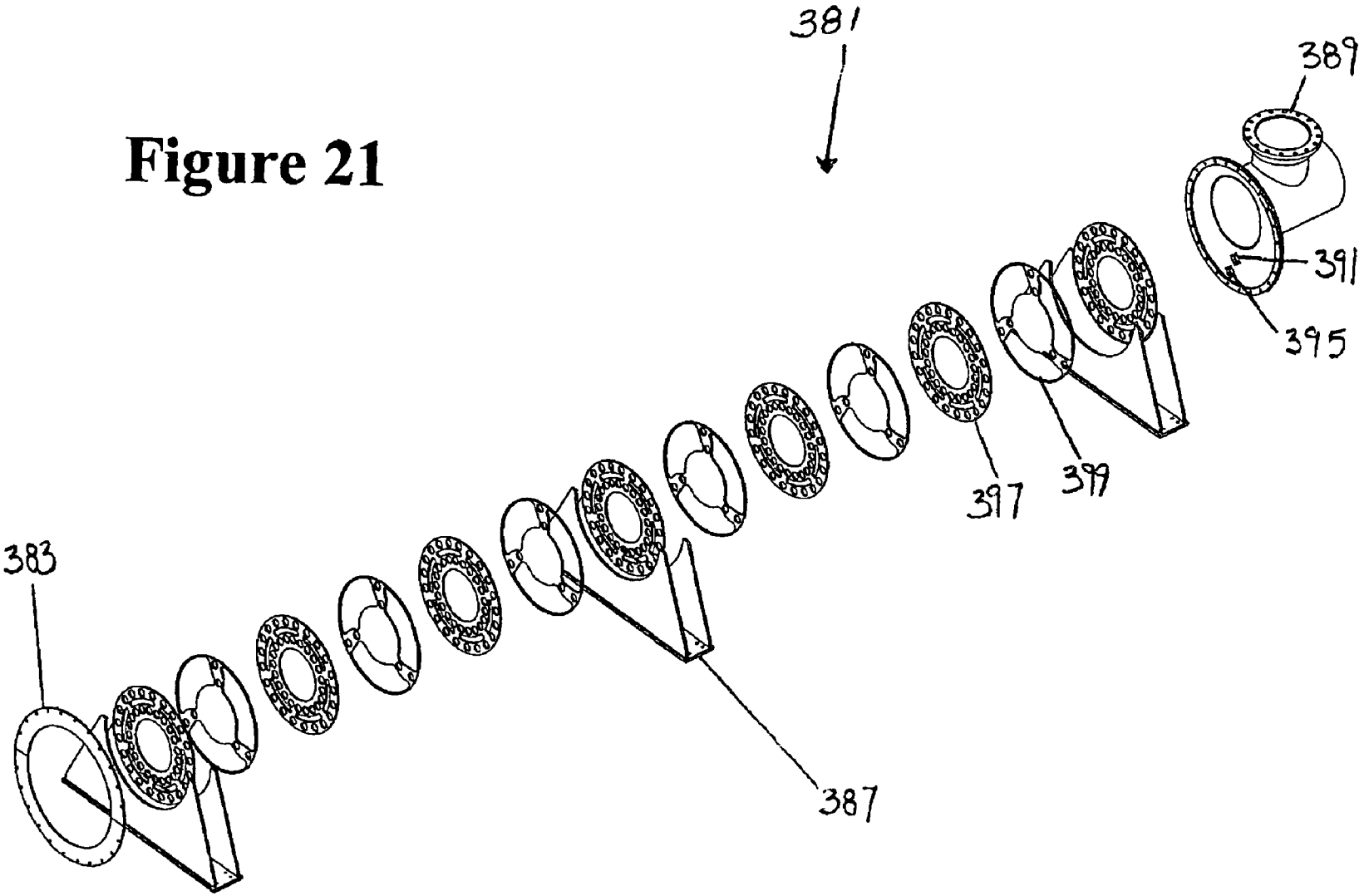
FIG. 21 is a cutaway view of the heater coil section without the tubes and the outer shell showing the coil supports and the air baffles.

FIG. 21 is a cutaway view of the heater coil section 381 without the tubes 393 and the outer shell 383 showing the coil supports 397 and the air baffles 399.

Figure 22:
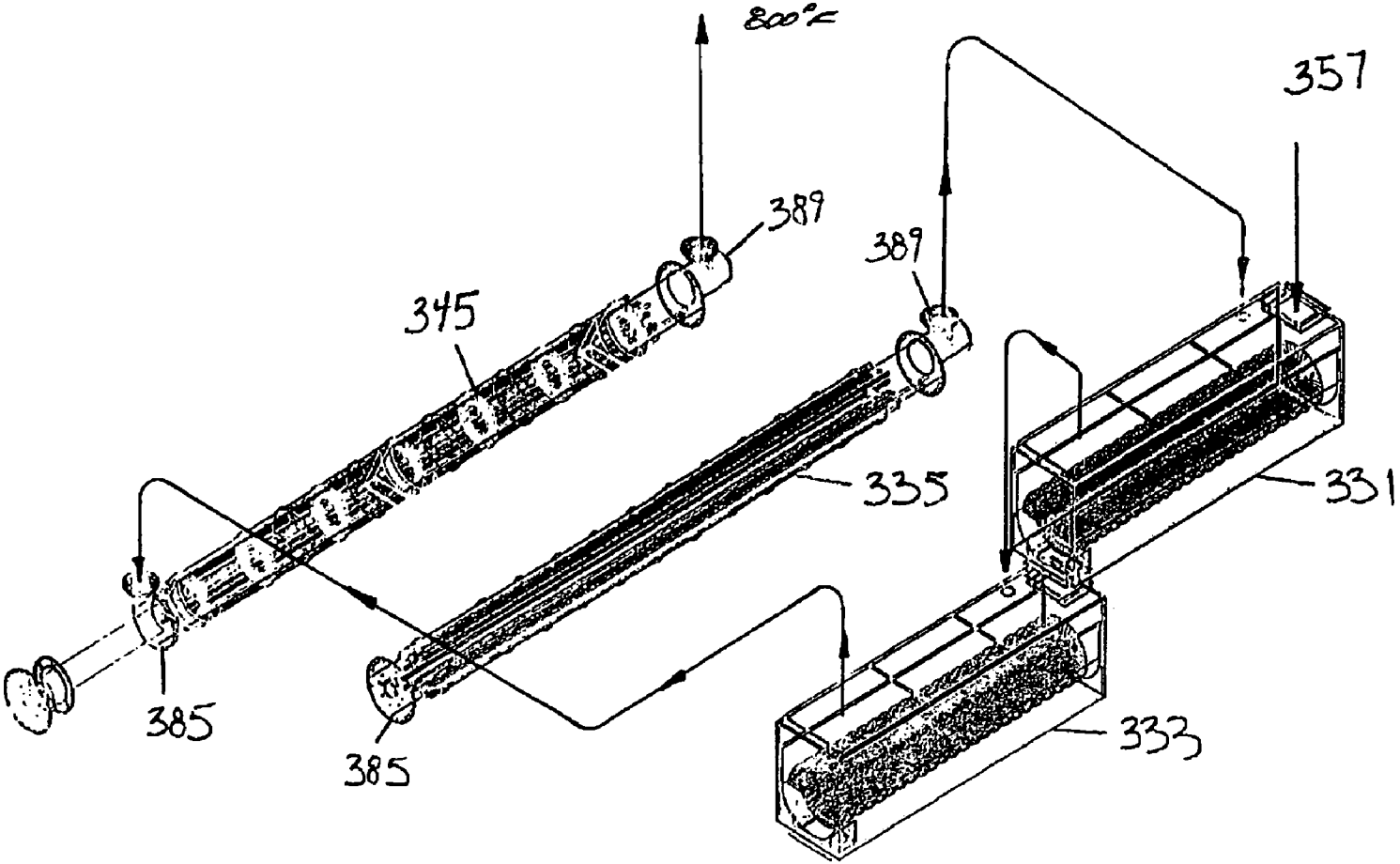
FIG. 22 is a schematic view of the hot sweep airflow.

FIG. 22 is a schematic view of the hot sweep airflow. Heated air passes from the primary oil heater 335 into the primary RAP heater 331. The hot air then passes through the primary RAP heater 331 and into the secondary RAP heater 333. The hot air passes through the secondary RAP heater 333 and to the secondary oil heater 345. After passing through the secondary oil heater 345 the hot air is exhausted to atmosphere.

Figure 23:
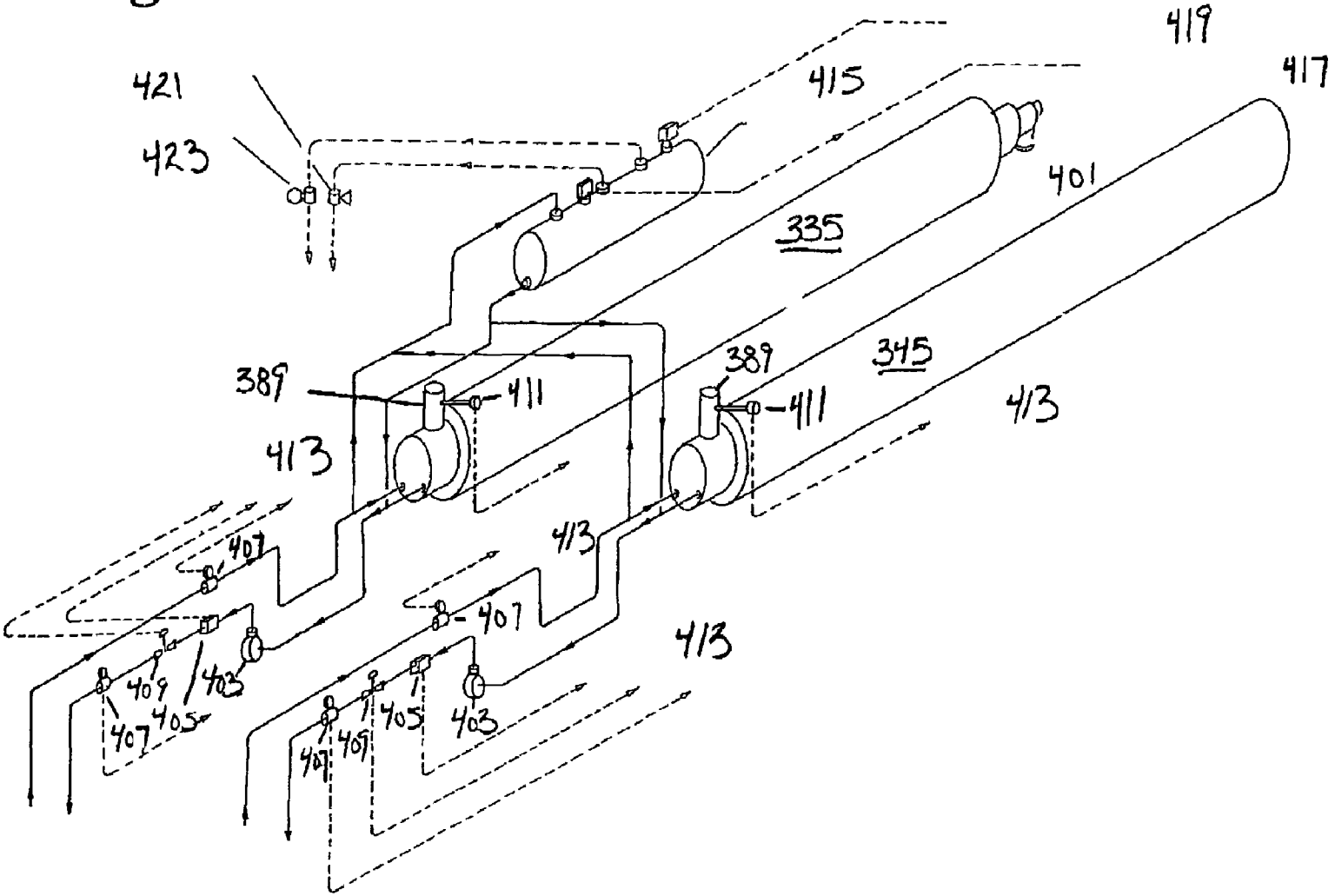
FIG. 23 is a heat exchanger control schematic.

FIG. 23 is a heat exchanger control schematic. The primary heat exchanger 335 and the secondary heat exchanger 345 include burners 401 on one end and pipe connections 389 on the opposite end. Control systems include hot oil circulating pumps 403, proof of flow switches 405, hot oil feed temperature sensors 407, hot oil feed pressure sensors 409, and exchanger exhaust gas temperature sensors 411. Other components may include a pressurized surge tank 415, a surge tank temperature sensor 417, a low oil level cutoff switch 419, a manual reset over pressure vent valve 421, and an emergency rupture, disc 423. All sensors feed to a control panel 413.

Figure 24:
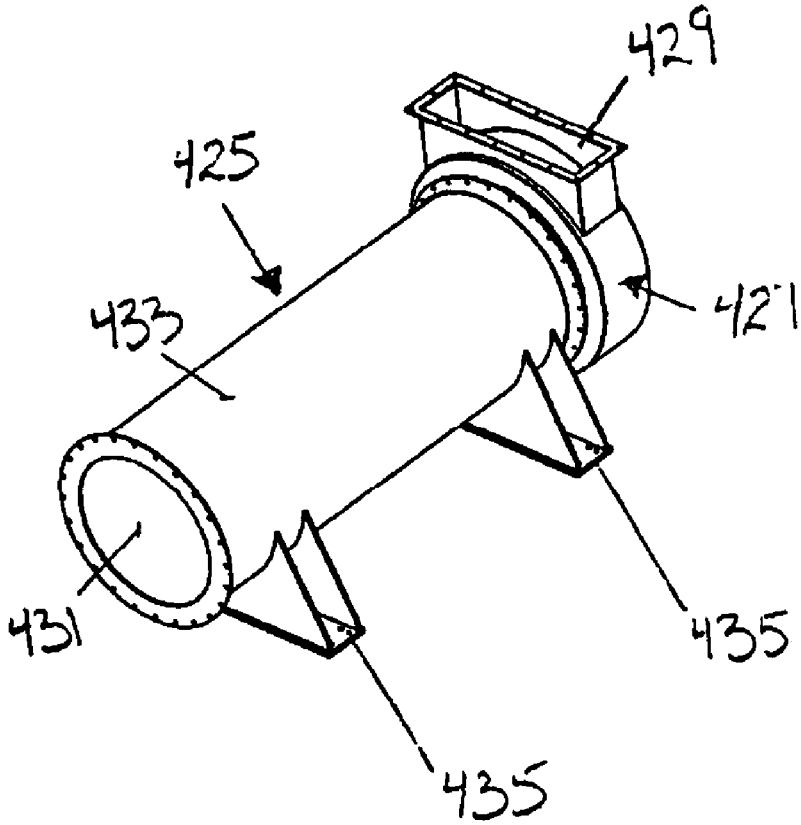
FIG. 24 is a perspective view of the combustion chamber with oxidizer intake.
Figure 25:
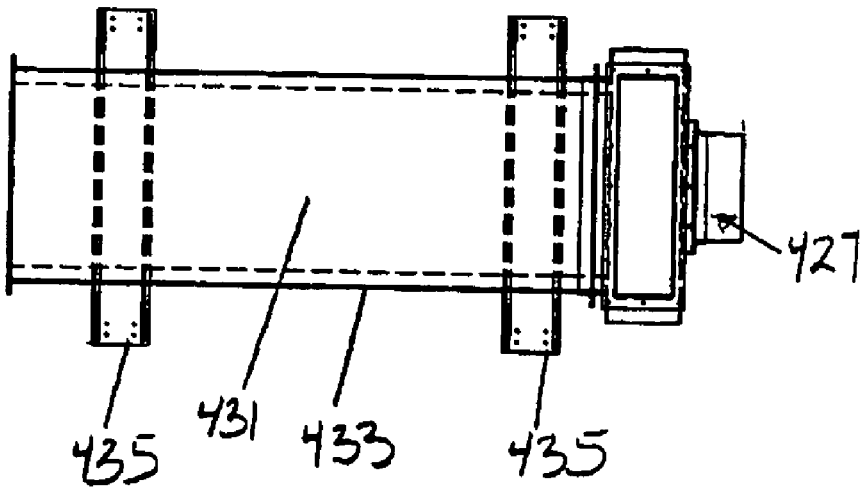
FIG. 25 is a top view of the combustion chamber with oxidizer intake.

FIG. 24 and FIG. 25 show a combustion chamber 425 with oxidizer intake 427. Oxidizer enters through an opening 429 and is fed into the main combustion chamber 431 surrounded by an outer shell 433. Footings 435 provide a stable base for the combustion chamber 425.

Figure 26:
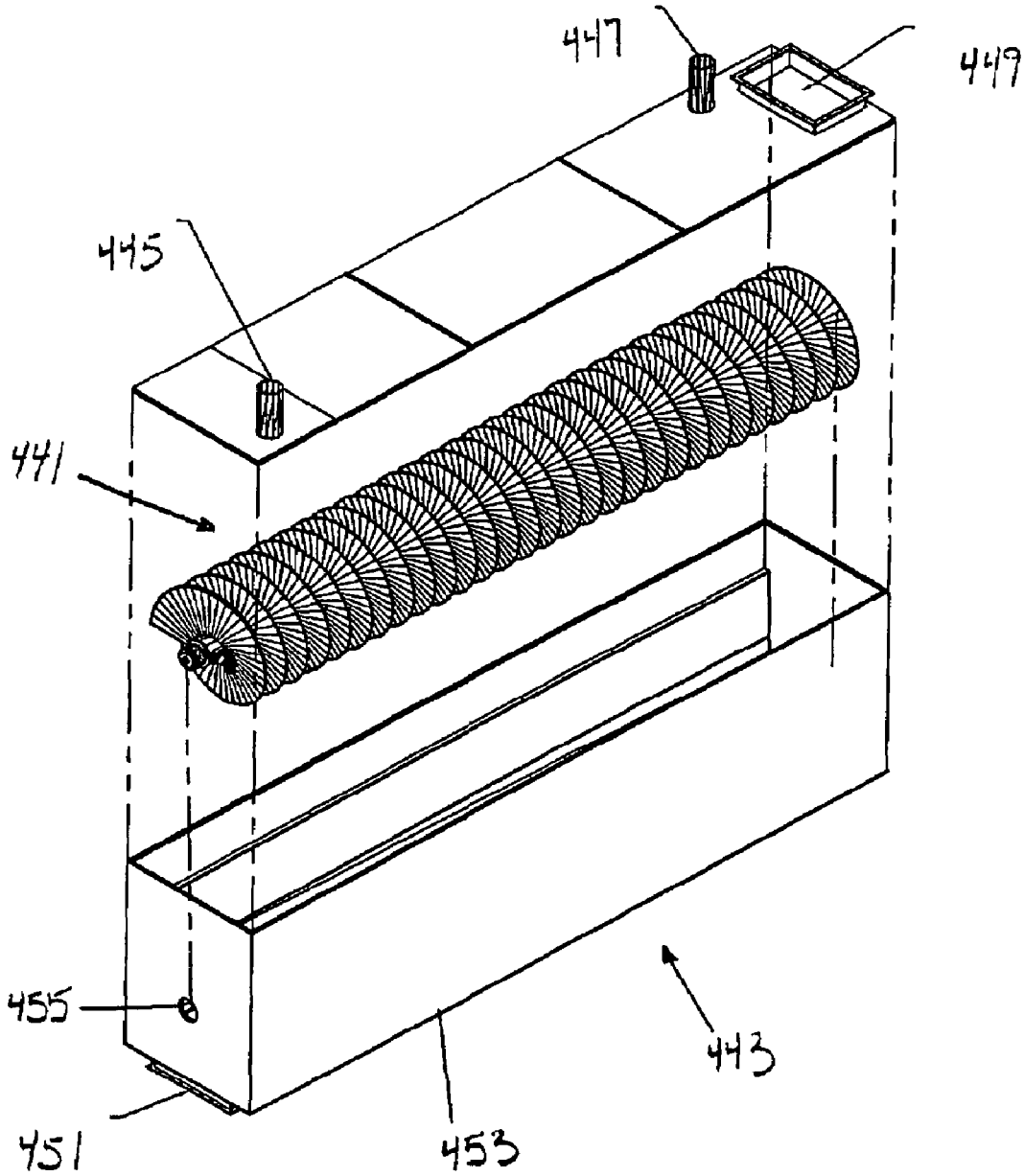
FIG. 26 is an exploded view of a heated auger.

FIG. 26 is an exploded view of a heated auger 441 in a RAP heater 443. The RAP heater has a hot air inlet 445, a hot air outlet 447, a material inlet 449, a material outlet 451, and an outer case 453. Hot oil flows in and out of openings 455 in the RAP heater 443 case 453. The hot oil then travels through the heated auger 441 and heats the RAP.

In a preferred embodiment, two or more separate and distinctly independent screw conveyors are used. The two or more conveyors are placed in series such that a primary unit begins the RAP heating and drying process. This allows one or more secondary units to direct energy into elevating the materials from approximately 180 to 300° F. or mix temperature. This configuration allows for a modular design. Adding one or more additional primary and secondary sets of units, themselves in series, increases capacity. This parallel production mode thus increases tonnage throughput at a site location.

The process of the present invention requires time, temperature and turbulence in order to function properly. The material must "dwell" for a sufficient time to accomplish both drying and heating of the materials. Unless the drying function happens first and the elevated moisture is evacuated from the material within the first auger pass, the second auger will not allow material to accept heat while in a high moisture evacuation environment. Once the water is removed the RAP will readily accept heat and climb rapidly to finished product temperatures.

In alternative embodiments, setups that differ from the two or more separate and distinctly independent screw conveyors in series may be used. Standard, single heated augers may also be used. Parallel systems, as opposed to series systems, may be used. However, dwell times are increased and the speed of the units is decreased. Twin shaft augers, triple shaft augers, or similar type augers may also be incorporated into the method and apparatus of the present invention.

In other alternative embodiments, heating may be accomplished by direct firing the auger overhead cavity to get higher, quicker heat to the RAP. Another method of heating is to direct fire the inside hollow cavity of the auger blades and hollow shaft or to direct fire the outer jackets in order to heat the RAP.

Figure 27:
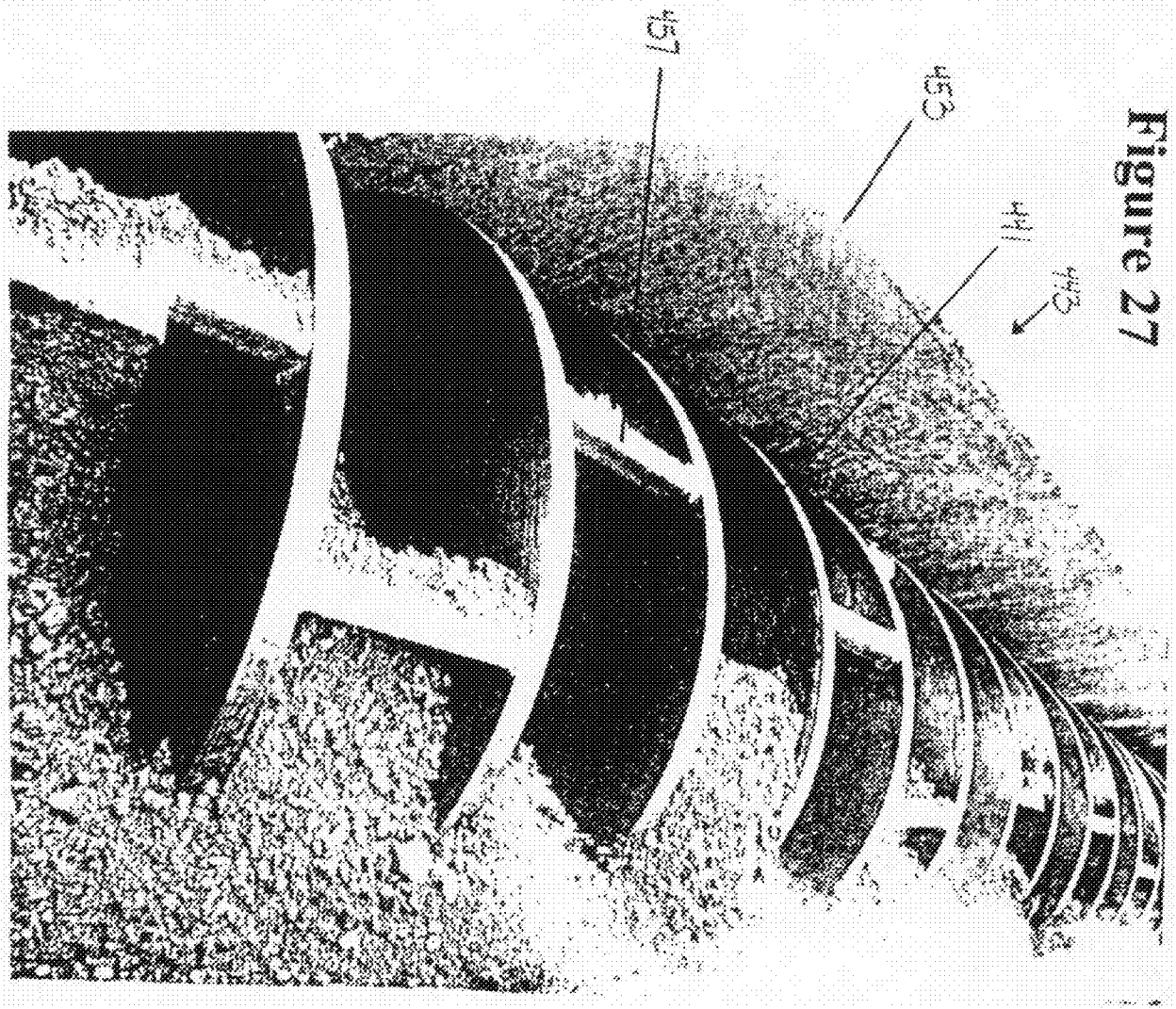
FIG. 27 is a perspective view of the auger with tines.
Figure 28:
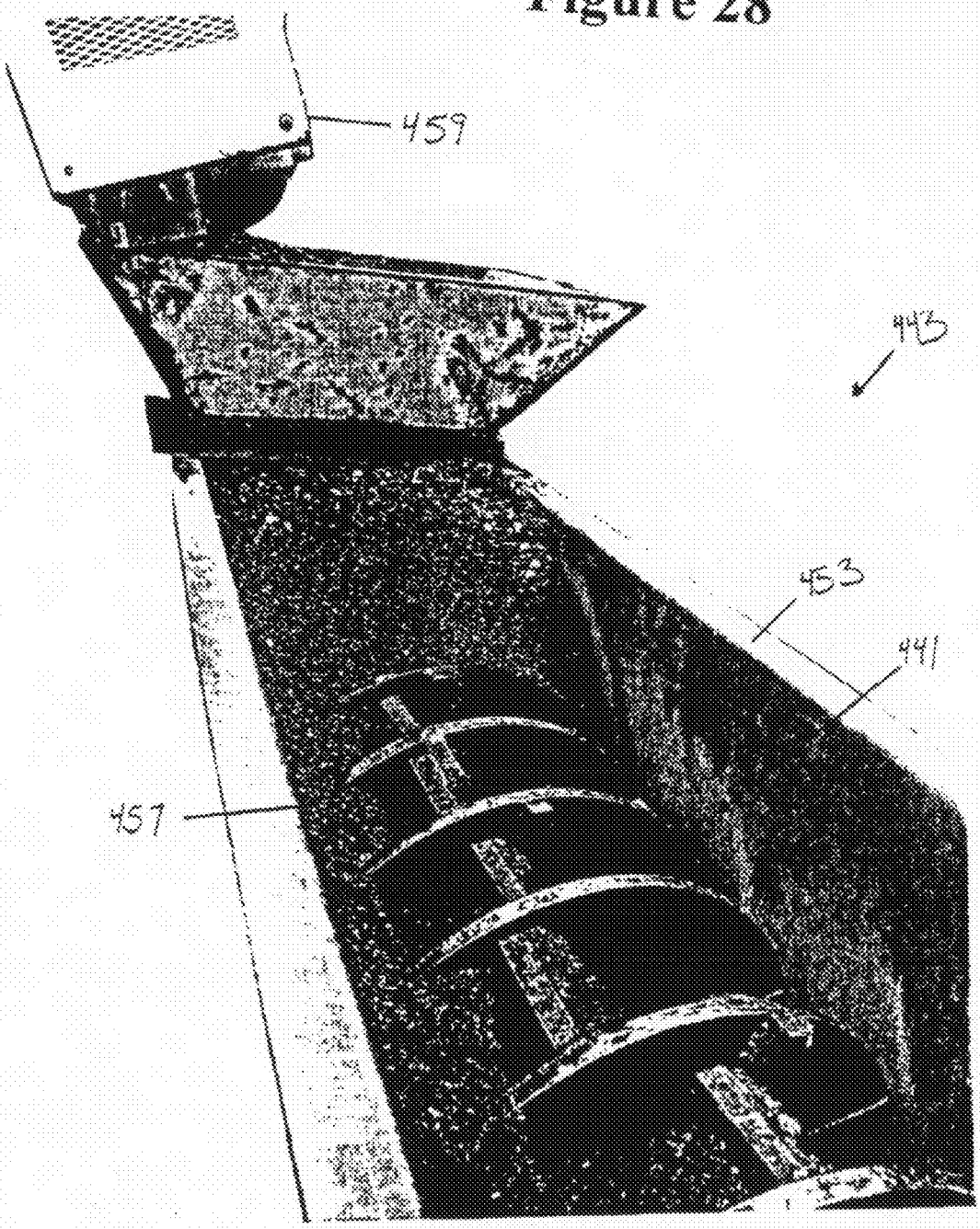
FIG. 28 is a perspective view of the auger with tines and feeder.

FIG. 27 and FIG. 28 show an auger 441 with tines 457. A feeder 459 feeds RAP into a RAP heater 443. The heated auger 441 moves the RAP along the case 453 and mixes the RAP as it moves. The auger 441 of the present invention may or may not have tines 457 to aid in mixing. The tines 457 are affixed to the trailing side of each flight. Any number of different patterns of tines 457 is possible depending on the application. The location, size and number of tines 457 are determined by the diameter of the flight. The tines 457 and their placement are critical to the turbulence pattern of the RAP as it proceeds through the trough. The tines 457 provide the lift and roll flow pattern necessary for coating efficiency, heat transfer efficiency and to prevent material size segregation. Tines 457 may be all shapes and sizes and found in various locations and number. Some tine shapes include, but are not limited to, round, oval, square, rectangular, curved, or straight. Sizes includes, but are not limited to, short or long. Locations include, but are not limited to, at the tip of a flight, at the center of a flight, on the shaft, etc.

The following are components that can be applied and added in various combinations to the system as options: diesel fueled generator, propane fueled generator, diesel tank, propane tank, landing & leveling jacks, enclosed van body with sound proofing and air fans, night lighting system, belly pan spill containment, batch hopper weigh out with load cell system data logging system, cement sand injection hopper, and/or foam flood fire control system with alarms.

While the invention has been described with reference to specific embodiments, modifications and variations of the invention may be constructed without departing from the scope of the invention, which is defined in the following claims.

The invention claimed is:

1. An asphalt materials processor comprising:

one or more material feeds, one or more loading feeders, one or more material heaters, one or more augers within the one or more material heaters, a hot fluid transportation system for transporting fluid from one or more hot fluid heaters to the one or more material heaters and back, hot fluid within the hot fluid transportation system, one or more heat sources for providing heat to the hot fluid in the hot fluid transportation system, a hot gas transportation system for transporting hot gas from the one or more hot fluid heaters to the one or more material heaters and back, a hot gas exhaust system, a control system comprising sensors, pumps and motors, and a fuel source.

2. The apparatus of claim 1, wherein the one or more material feeds is selected from the group consisting of recycled asphalt pavement millings, virgin aggregate mix, and combinations thereof.

3. The apparatus of claim 2, further comprising one or more recycled asphalt pavement milling loading feeders separate from virgin aggregate mix loading feeders.

4. The apparatus of claim 1, further comprising one or more conveyors for transporting the one or more material feeds from the one or more loading feeders to the one or more material heaters.

5. The apparatus of claim 1, further comprising an oversize scalping screen between the one or more material feeds and the one or more material heaters.

6. The apparatus of claim 1, wherein the one or more material heaters comprise two or more material heaters in series.

7. The apparatus of claim 6, wherein the two or more material heaters in series comprise a primary material heater feeding into one or more secondary material heaters.

8. The apparatus of claim 1, wherein the one or more material heaters are in parallel.

9. The apparatus of claim 1, wherein the one or more augers are heated, hollow, screw augers.

10. The apparatus of claim 9, wherein the one or more augers are heated by hot fluid flowing through the one or more augers from the hot fluid transportation system.

11. The apparatus of claim 1, further comprising tines on the one or more augers.

12. The apparatus of claim 1, wherein the material feeds are heated by direct firing an auger overhead cavity.

13. The apparatus of claim 1, wherein the material feeds are heated by direct firing an inside hollow cavity of auger blades and hollow shafts of the one or more augers.

14. The apparatus of claim 1, wherein the material feeds are heated by direct firing a jacket of the one or more material heaters.

15. The apparatus of claim 1, wherein the one or more hot fluid heaters are standard hot oil heaters.

16. The apparatus of claim 1, wherein the one or more hot fluid heaters are direct fired tube in tube heat exchangers.

17. The apparatus of claim 16, wherein the one or more hot fluid heaters comprise a combustion chamber, a heater coil, connections between the combustion chamber and a heater coil section, connections between the heater coil section and the hot gas transportation system, heater coil supports, air baffles and a cover.

18. The apparatus of claim 1, wherein the hot fluid transportation system is a pressurized hot oil system for reducing emissions.

19. The apparatus of claim 1, wherein the hot fluid transportation system is an atmospherically vented system.

20. The apparatus of claim 1, wherein the hot fluid transportation system comprises a primary heater and an oxidizer for removing contaminants from the hot gas transportation system prior to exhaust.

21. The apparatus of claim 1, wherein the hot fluid in the hot fluid transportation system is at approximately 650° F.

22. The apparatus of claim 1, wherein the hot fluid in the hot fluid transportation system is liquid salt.

23. The apparatus of claim 1, wherein the combustion in the hot fluid transportation system occurs in an oxygen deficient environment.

24. The apparatus of claim 1, wherein the hot gas transportation system transfers hot gas from a primary hot fluid heater to a primary material heater to a secondary material heater to a secondary hot fluid heater and then to an exhaust.

25. The apparatus of claim 1, further comprising one or more conveyors from an exit of the one or more material heaters to a load out.

26. The apparatus of claim 1, further comprising fuel storage.

27. The apparatus of claim 1, further comprising rejuvenator storage and rejuvenator transportation system for injecting rejuvenator into the one or more material feeds at an appropriate time.

28. The apparatus of claim 1, further comprising options selected from the group consisting of a diesel fueled generator, propane fueled generator, diesel tank, propane tank, landing & leveling jacks, enclosed van body with sound proofing and air fans, night lighting system, belly pan spill containment, batch hopper weigh out with load cell system data logging system, cement sand injection hopper, foam flood fire control system with alarms, and combinations thereof.

29. The apparatus of claim 1, wherein the apparatus is used for creating virgin hot mix, recycled asphalt milling pavement, hot mix, warm mix or cold mix.

30. The apparatus of claim 1, wherein dwelling times within the one or more material heaters are changeable.

31. The apparatus of claim 1, wherein sizes of the one or more material feeds control a finished design mix.

32. The apparatus of claim 1, wherein adding modular sets of one or more material heaters in parallel increases capacity.

33. The apparatus of claim 1, wherein the apparatus is stationary or mobile.

34. The apparatus of claim 1, further comprising one or more storage silos.

35. The apparatus of claim 34, further comprising hot oil jackets and insulation on the one or more storage silos.

36. The apparatus of claim 34, further comprising one or more conveyors from the one or more material heaters to the one or more storage silos.

37. An asphalt materials processing method comprising:

feeding one or more material feeds from one or more loading feeders into one or more material heaters, mixing the one or more material feeds in the one or more material heaters with one or more augers, heating hot fluid within a hot fluid transportation system with one or more heat sources for transporting fluid from one or more hot fluid heaters to the one or more material heaters and back, heating the one or more material feeds in the one or more material heaters with the hot fluid, removing water from the one or more material feeds in the one or more material heaters, raising the temperature of the one or more material feeds in the one or more material heaters, transporting hot gas with a hot gas transportation system from the one or more hot fluid heaters to the one or more material heaters and back, exhausting the hot gas with a hot gas exhaust system, controlling production of a finished product with a control system including sensors, pumps and motors, removing the finished product from the one or more material heaters, and providing a fuel source.

38. The method of claim 37, wherein the one or more material feeds is selected from the group consisting of recycled asphalt pavement millings, virgin aggregate mix, and combinations thereof.

39. The method of claim 37, further comprising transporting the one or more material feeds and the finished product on one or more conveyors.

40. The method of claim 37, wherein the one or more material heaters comprise two or more material heaters in series.

41. The method of claim 40, wherein the two or more material heaters in series comprise a primary material heater feeding into one or more secondary material heaters.

42. The method of claim 37, wherein the one or more material heaters are in parallel.

43. The method of claim 37, wherein the one or more augers are heated, hollow, screw augers.

44. The method of claim 43, further comprising heating the one or more augers with hot fluid flowing through the one or more augers from the hot fluid transportation system.

45. The method of claim 37, wherein the one or more augers have tines.

46. The method of claim 37, wherein direct firing an auger overhead cavity heats the materials feeds.

47. The method of claim 37, wherein direct firing an inside hollow cavity of auger blades and hollow shafts of the one or more augers heats the material feeds.

48. The method of claim 37, wherein direct firing a jacket of the one or more material heaters heats the material feeds.

49. The method of claim 37, wherein the one or more hot fluid heaters are standard hot oil heaters.

50. The method of claim 37, wherein the one or more hot fluid heaters are direct fired tube in tube heat exchangers.

51. The method of claim 50, wherein the one or more hot fluid heaters comprise a combustion chamber, a heater coil, connections between the combustion chamber and a heater coil section, connections between the heater coil section and the hot gas transportation system, heater coil supports, air baffles and a cover.

52. The method of claim 37, wherein the hot fluid transportation system comprises a primary heater and an oxidizer for removing contaminants from the hot gas transportation system prior to exhaust.

53. The method of claim 37, wherein the hot gas transportation system transfers hot gas from a primary hot fluid heater to a primary material heater to a secondary material heater to a secondary hot fluid heater and then to an exhaust.

54. The method of claim 37, further comprising injecting rejuvenator into the one or more material feeds at an appropriate time.

55. The method of claim 37, wherein the method is used for creating virgin hot mix, recycled asphalt milling pavement, hot mix, warm mix, or cold mix.

56. The method of claim 37, further comprising altering dwelling times within the one or more material heaters.

57. The method of claim 37, further comprising adding modular sets of one or more material heaters in parallel increases capacity.

58. The method of claim 37, further comprising transferring the finished product to one or more storage silos.

* * * * *